US006781300B1

(12) United States Patent
Edinger

(10) Patent No.: US 6,781,300 B1
(45) Date of Patent: Aug. 24, 2004

(54) LASER BASED ELECTRON BEAM GUN

(76) Inventor: Ralf Klaus Edinger, 301-3023 Quebec Street, Vancouver, B.C. (CA), V5T 3B2

( * ) Notice: Subject to any disclaimer, the term of this patent is extended or adjusted under 35 U.S.C. 154(b) by 0 days.

(21) Appl. No.: 09/369,522

(22) Filed: Aug. 6, 1999

(51) Int. Cl.[7] ..... H01J 63/04
(52) U.S. Cl. ..... 313/448; 313/542; 219/121.12
(58) Field of Search ..... 313/373, 375.77, 313/379, 384, 389, 409, 411, 444, 446–449, 523, 530, 537, 541–542, 544; 218/121.45, 121.5, 121.52, 121.46, 121.63, 121.64, 121.84; 315/169.1, 169.3

(56) References Cited

U.S. PATENT DOCUMENTS

| | | | | |
|---|---|---|---|---|
| 3,433,922 A | | 3/1969 | McNabb | |
| 3,621,324 A | | 11/1971 | Fink | |
| 4,317,983 A | | 3/1982 | Scheffels et al. | |
| 4,831,230 A | * | 5/1989 | Lemelson | 219/121.12 |
| 5,552,675 A | * | 9/1996 | Lemelson | 315/111.21 |
| 5,700,989 A | | 12/1997 | Dykhno et al. | |
| 5,705,785 A | | 1/1998 | Dykhno et al. | |
| 6,376,985 B2 | * | 4/2002 | Lee et al. | 313/542 |

* cited by examiner

*Primary Examiner*—Vip Patel
*Assistant Examiner*—Joseph Williams
(74) *Attorney, Agent, or Firm*—Horst Kasper

(57) ABSTRACT

This invention relates to electron guns, each comprising of an indirectly heated cathode, a gate electrode and an anode, for generating electron beams of various shapes and power that are preferably used to machine workpieces. Thus cathodes can be used with various geometric designs. Thus cathodes of the most varied geometrical shapes can be used. Along with band cathodes and band cathodes with bodies attached to them, massive cathodes such as bolt-type cathodes can also be applied. Using massive bodies results in a longer service life of the cathode as compared to band cathodes. Another benefit is that the service life of the heat source for the cathode is identical to the service life of the laser used. It is particularly advantageous to place the laser outside the housing, which ensures a very long service life of this source of heat. At the same time, the solution according to the invention is distinguished by an indirect temperature measurement of the cathode. This allows the radiation property to be controlled and improved. There is thus a type of compensation for the effects of the craters that may occur on the emission surface of the cathode.

20 Claims, 19 Drawing Sheets

LASER BASED ELECTRON BEAM GUN

BACKGROUND OF THE INVENTION

Field of the Invention

The present invention relates to an electron gun employing an indirectly heated cathode, gate electrode and anode.

Electron guns constructed for and used for processing workpieces have been generally known and there exist many publications relating to such electron guns.

A majority of conventional electron guns are based on directly heated cathodes. These cathodes are heated separately by a heating voltage, and an high voltage for electron escape from the cathode surface and for electron acceleration is applied to cathode independent of a heating means for the cathode. This separation of heating voltage and electron acceleration voltage is necessary in connection with the required overlay of the two electrical voltage variables. The electrons emitted from the cathode can only be controlled with some effort due to the high voltage involved. Furthermore, the only cathode type that can be used with direct heating is a band cathode. Such constructions have been described, for example, in U.S. Pat. No. 386,222, U.S. Pat. No. 3,433,922, and U.S. Pat. No. 4,317,983.

A combined laser and plasma arc welding torch is taught in U.S. Pat. No. 5,700,989 and 5,700,785 to Dykhno et al. In each case the laser beam passes through a hole in a cathode. U.S. Pat. No. 3,621,324 to Fink teaches a high power cathode. The bolt electrode is heated by electron bombardment.

Indirectly heated cathodes are associated with the advantage of in general allowing a longer service life also allowing more independence for geometrical shaping of the electron gun configurations. Known constructions employ electric heating systems and in particular resistance heating as an energy source for indirect heating. Such configurations are presented in the printed patent documents European Patent Document EP 0,416,535, European Patent Document EP 0,505,211 and German patent Document DE 44,43,830.

High electric currents in the electric heater are required to achieve a sufficient temperature that will cause emission of electrons from the cathode. Moreover, the resistive sources of heat are non-focussed such that a major part of the thermal energy generated by the heater does not reach an appropriate cathode surface for electron emission and a large part of the heat generated in the heater is dissipated into the space of the electron gun and to the casing of the electron gun. The uncontrolled dissipation of thermal energy by the electric heater results in an increase of the electric energy required to achieve the required cathode temperature. This is why indirectly heated electron guns can only be used efficiently in lower-power electron guns. Indirectly heated electron guns are less suited for high-power electron guns. There is only limited control of the generation process of electron emission due to the non-directional thermal radiation in case of an indirect source of heat.

Band cathodes are conventionally heated directly by means of an electric resistor heating element with electrical consumptions of for example 8 volts and 10 amps. Such electric resistors encountered difficulties with the connections to the power source, because the connection resistance would frequently be higher than the resistance of the heating element.

SUMMARY OF THE INVENTION

Purposes of the Invention

It is an object of the present invention to furnish an electron gun which is convenient to control in its output characteristics.

It is another object of the present invention to eliminate problems in electron guns associated with high heating currents for the cathode.

It is yet another purpose of the present invention to eliminate problems in electron guns associated with heating of the junctions to the cathode heater.

It is a still further purpose of the present invention to avoid a magnetic field generated by a heating current for the cathode heater from interfering with the direction and/or bundling of the emitted electron beam.

These and other objects and advantages of the present invention will become evident from the description which follows.

BRIEF DESCRIPTION OF THE INVENTION

The present invention provides an electron gun comprising an indirectly heated cathode, a gate electrode and an anode, for generating electron beams of various shapes and power that are preferably used for processing workpieces.

The electron gun comprises a housing, a cathode having an emission surface on a first side and an irradiation surface on a second side of the cathode disposed opposite to the first side and said cathode being mounted in the housing, a gate electrode disposed adjacent to the cathode for controlling the beam of electrons emitted by the cathode and mounted in the housing, an anode mounted in the housing and disposed at an appropriate distance from the cathode for building up a voltage between cathode and anode and for accelerating electrons emitted by the cathode, a source of a laser beam for directing a laser beam to the irradiation surface of the cathode.

The source of the laser beam is a member selected from the group consisting of solid-state laser, an optical facility to decouple laser beams and combinations thereof. The source of the laser beam is placed opposite to a surface other than the emission surface of the cathode. The side disposed opposite to the emission surface of the cathode is located in the laser beam path.

A member selected from the group consisting of a photodetector, a solid-state image sensor, an optical fiber waveguide connected to a photo detector, an optical fiber waveguide connected to a solid-state image sensor and combinations thereof is placed opposite to a surface of the anode and in the path of the light of the laser beam. The source of the laser beam and the member selected from the group consisting of a photodetector, a solid-state image sensor, an optical fiber waveguide connected to a photo detector, an optical fiber waveguide connected to a solid-state image sensor and combinations thereof and the member selected from the group consisting of a control unit, a closed-loop control system and combinations thereof are interconnected.

The source of the laser beam can be an optical facility to decouple a laser beam together with and optically connected to a laser beam generating facility through at least one optical fiber. The laser beam generating facility for generating a laser beam is disposed outside of the housing.

An optical fiber can be located in the waveguide. A hole of the cathode anchor forms a direct electroconductive connection to the waveguide.

A high voltage plug is connected to the power supply unit. The waveguide is a component of the high-voltage plug. A first end of said waveguide is placed outside the housing wherein and a second end of said waveguide is disposed at a distance from about 2 to 150 millimeters relative to the cathode or inside the cathode anchor. The waveguide can be furnished with an electroconductive connection to the power supply unit for the cathode.

The facility generating the laser beam can be a solid-state laser.

The facility generating the laser beam can be connected to the optical fiber through a member selected from the group consisting of a spherical lens, a half sphere, a taper, a two-sided beveling of the optical fiber, and combinations thereof.

The optical facility to decouple laser beams can be connected through the fiber laser to a light beam generating facility that functions as a pumping source. The cathode can be located in the laser beam path.

The optical facility to decouple laser beams can be a member selected from the group consisting of the end of at least one optical fiber, a half sphere placed at the end of said optical fiber, a lens placed in the downstream beam path from the end of said optical fiber, and combinations thereof. The half sphere can be melted on and comprises a cast resin.

The facility to decouple laser beams can comprise two lenses placed at a distance of from about 5 to 50 millimeters relative to one another. The cathode can be a member selected from the group consisting of a band cathode, a band cathode with an electrode emitting body attached to it, a pin cathode, and combinations thereof. A surface of said pin cathode can comprise an indentation and/or a prominence and/or a projection and/or a protrusion, and wherein the electron-emitting surface is circular. The electron-emitting component of the pin cathode can be a bolt.

Measuring equipment can be used to determine laser power and the resulting cathode temperature. A member selected from the group consisting of photodetector, solid-state image sensor, a control unit, a closed-loop control system, and combinations thereof can be part of the measuring equipment.

An electron gun according to the present invention is furnished with a cathode heated indirectly by irradiation with a laser beam, with a gate electrode, and with an anode. No heating current flows through a cathode constructed in this way. Thus a cathode of the most varied geometrical shape can be used. Massive cathodes such as bolt-type cathodes can be employed in addition to band cathodes and band cathodes with bodies attached to them.

Using a massive body for a cathode results in a longer service life of the cathode as compared to a band cathode. The surface opposite the emission surface-should be the target of the irradiating laser beam. Thus the indirect cathode heating by irradiation is implemented in a simple construction.

The electron gun construction according to the present invention is associated with the further benefit of rendering the service life of the irradiative source of heat for the cathode is identical with the service life of the laser used. It is particularly advantageous to place the laser outside the housing, as this ensures a very long service life of this source of heat.

An indirect temperature measurement of the cathode allows control of the emission of electrons and thus an improvement of the overall emission property of the cathode. The effect of craters that may develop on the emission surface of the cathode can be compensated by for example adjusting the irradiation with the laser beam.

According to the present invention, it is further disclosed to place a facility for generating the laser beam outside the housing of the electron gun. In this way, the most varied lasers may be used. The type of the laser can be selected in accordance with the cathode temperature required for machining workpieces. This permits an efficient use of both the source of heat and the cathode. It can be easy to configure the electron gun depending on the type of workpieces to be machined and the number of workpieces to be processed. If the workpieces always remain the same, an electron gun can be constructed specifically adapted to these workpieces and constructed highly specialized, but such electron gun can easily be adapted to differing requirements when jobs change. This underlines the universal applicability of the electron gun according to the invention.

The geometric dimension of the cathode does not depend on the size of the housing of the electron gun only the optical facility to decouple laser beams and a section of the optical fiber are inside the housing thereby enabling to employ a very small size of an electron gun down to a miniature construction.

It is particularly advantageous in this context to use a solid-state laser that has the shape of a diode laser suitable for development.

Supply of an electrical potential to the cathode via an electroconductive waveguide into which the optical fiber is integrated ensures that the potential of the cathode is applied to the optical fiber. The optical fiber has to be placed on substantially the same potential as is the electrical potential of the cathode. The result of this is that the electron beam runs only towards the anode.

An integration of the electroconductive waveguide into a high-voltage plug results in a unit that can be handled easily. At the same time, the integration provides for a compact voltage potential supply to, and heating of the cathode. The required airtight leads to the electron gun are considerably reduced. Technological and economic expenditures required for the electron gun according tot he present invention are minimized.

Further ways to improve the efficiency of input into the optical fiber of the facility generating the laser beam is a direct connection, a connection via a spherical lens, a half sphere, a taper, or a two-sided beveling of the optical fiber.

The approximate coupling attenuations are as follows:

(5 to 8) dB for direct connection, 1.5 dB via spherical lens, (0.2 to 1) dB via a half sphere, (0.2 to 1) dB via a taper, and 1 dB for a two-sided beveling.

Such construction allows for a selection dependent upon the facility generating the laser beam, the cathode temperature to be achieved, or the most sensible solution in technological and economic terms.

A favorable embodiment is obtained when using a fiber laser. The fiber laser is pumped via an external facility that generates light beams and is located outside the housing of the electron gun. The optical fiber acts as an amplifier of the light beam coupled into it from the pumping source. Preferably, a laser diode should be used as a pumping source.

Other favorable embodiments of the optical facility to decouple laser beams are the end of at least one optical fiber itself, a half sphere placed at the end of an optical fiber, or at least one lens placed in the beam path downstream from the end of said optical fiber.

A most simple way of coupling the laser beam to the cathode is via the end of the optical fiber itself. A spacing provided between the end of the optical fiber and the cathode surface should be minimal for keeping radiation intensity losses as low as possible. Consideration of the high negative potential of the cathode should not be neglected. This is why the optical fiber is connected to the cathode potential at least at the end pointing towards the cathode. This coupling design is a most favorable embodiment in a technological and economic respect. No additional brackets and components for facilities to decouple laser beams are required. At the same time, there are no losses due to reflection and absorption at the boundary layers of the additional components.

A half sphere or lens placed at the end of the optical fiber acts as collimator, i.e. divergent laser beams that emerge from the optical fiber are converted into approximately parallel laser beams. This creates a point source.

The half sphere is either directly connected to the end of the optical fiber, or comprises the end of the optical fiber. The half sphere and the optical fiber form a unit requiring no additional fixing devices for the facility to decouple the laser beam. At the same time, placement of this unit opposite one cathode surface is less complicated. Moreover, the spacing can easily be adapted to the geometry of the cathode surface by changing the geometrical position of the optical fiber.

An embodiment of the half sphere that can be produced easily is either the molten end of the optical fiber itself, or an integrally cast resin half sphere. Another benefit is that no additional components are required in connection with the fiber. Thus the optical fiber can easily be adjusted to the cathode surface.

If a second lens is placed into the laser beam path after the first lens, then the laser beams are focused, and an intensity maximum is created in the focus point. Focusing also allows matching of the laser beam diameter and the diameter of a bolt-shaped cathode. Thus the circular surface of the bolt-type cathode is heated up by irradiation with the impinging laser beam.

An advantageous embodiment of the cathode includes a band cathode, a band cathode with an electron emitting body attached to it, or a body. Use of the body, either attached to the band cathode or just by itself increases the service life of the cathode as compared to a regular band cathode.

A minimum of one indentation or one prominence on the surface of said body used as a cathode, combined with a fixing device that at least partially receives the body of the cathode and comprising either at least one indentation of equal construction or one prominence of equal construction is a simple way to place the cathode in a fixed position inside the housing of the electron gun. This ensures constant radiation conditions.

A bolt-shaped cathode has a circular emission surface. An approximate circular electron beam is thus generated in interaction with the gate electrode and anode which ensures constant, direction-independent machining conditions for workpieces.

Measuring equipment containing the photodetector and solid-state image sensor and/or the control unit or closed-loop control system allows optimum tracking and control of the machining process. It is particularly advantageous to use this electron gun construction in machine-tools that are used universally, i.e. that are used to machine workpieces of various geometric shapes and materials that change constantly or at regular intervals.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
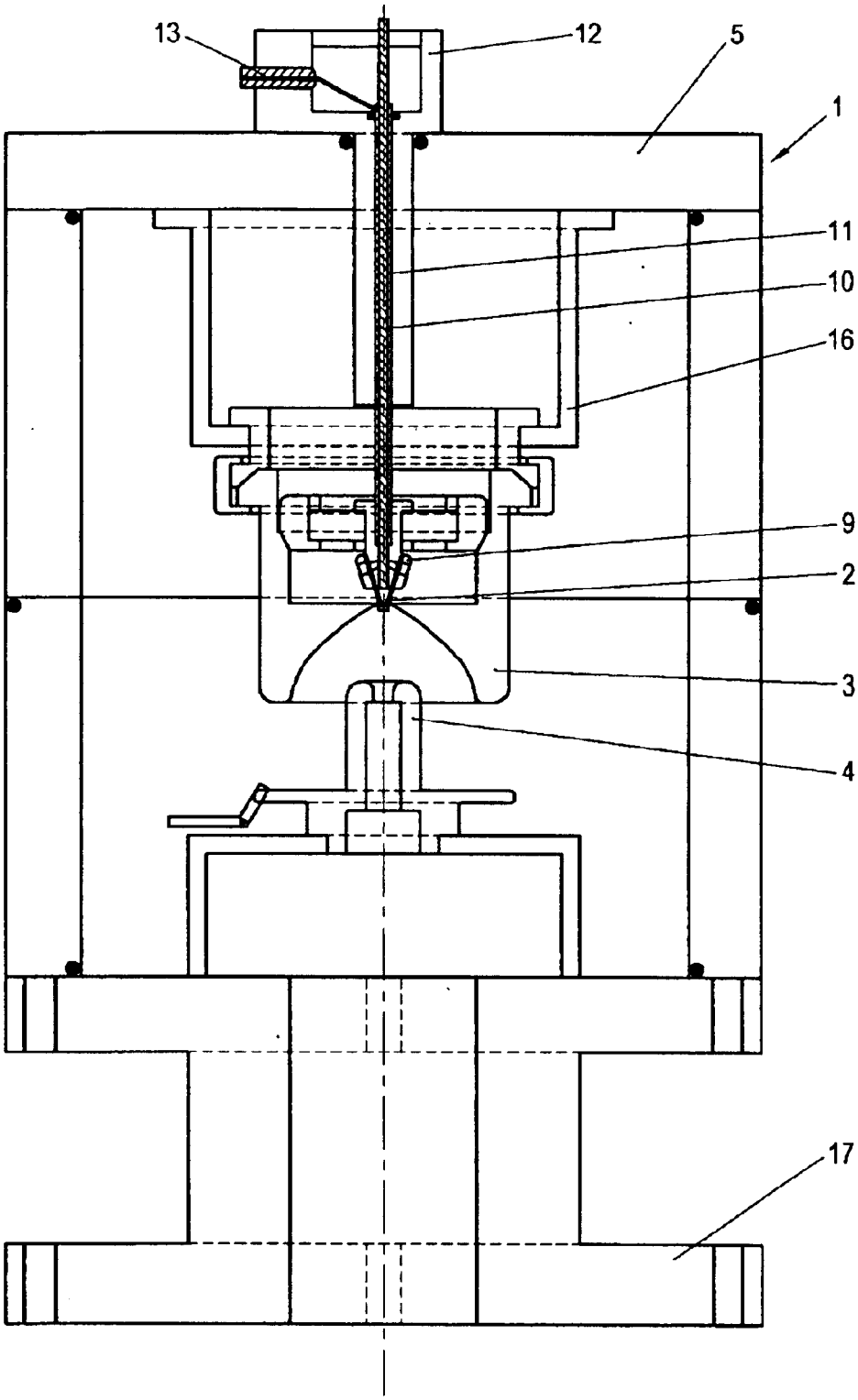
FIG. 1 is a vertical sectional view of a schematic diagram showing a vertical section of an electron gun with a band cathode.
Figure 2:
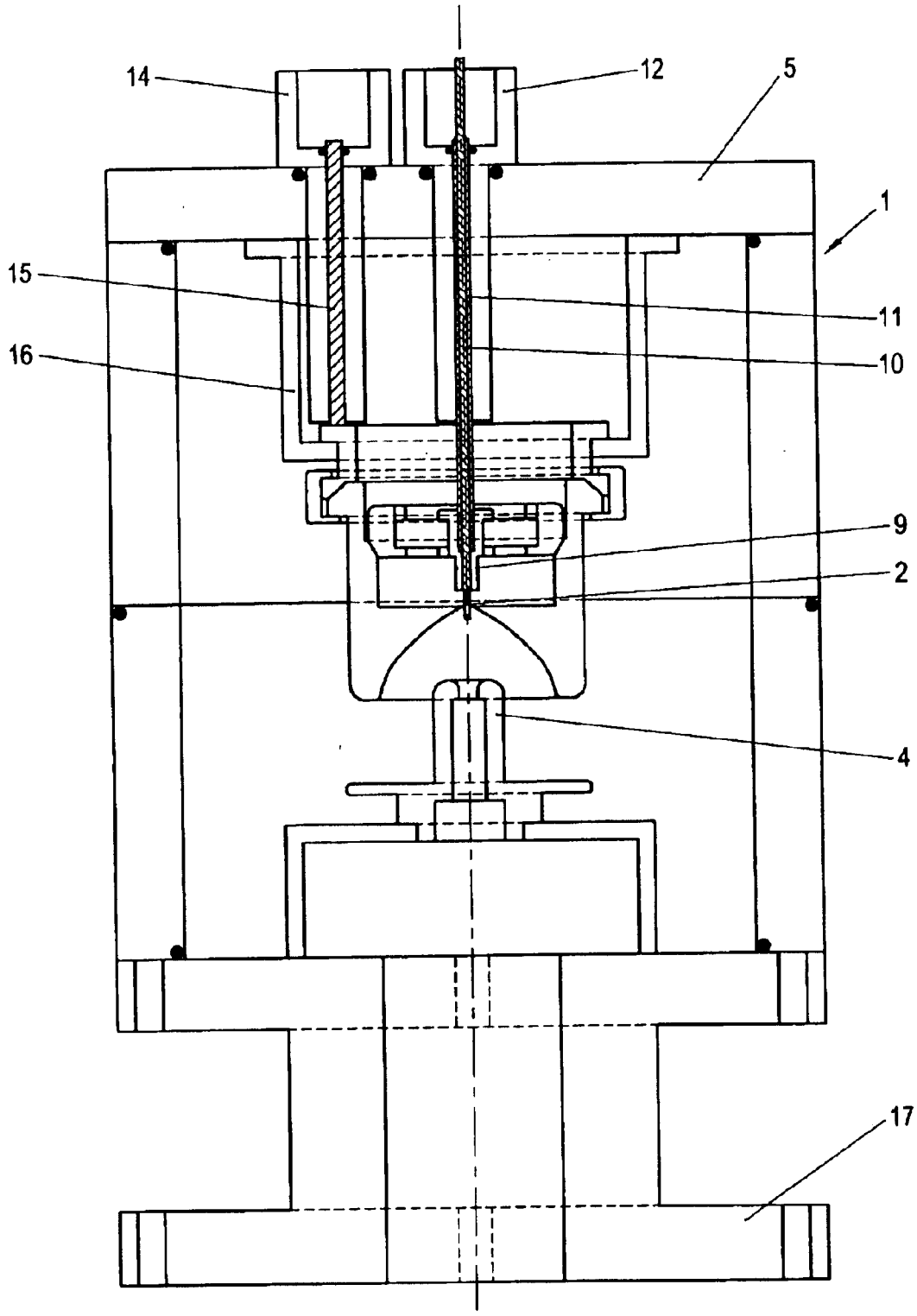
FIG. 2 is an enlarged vertical sectional view of the embodiment shown in FIG. 1 together with an emitted electron beam.

In accordance with the present invention there is provided an electron gun 1 comprising an irradiation heated cathode 2, a gate electrode 3, and an anode 4 (FIGS. 1–2). An optical fiber 10 directs a laser beam 20 onto the backside of the cathode 2 for heating the cathode 2 (See FIGS. 7–9 and FIGS. 14–16). Application of a high voltage between cathode 2 and anode 4 generates an electron beam 32 (FIGS. 14–16).

Cathodes suitable in the context of the present invention are described in the book Jorg Bretting, author, Information from technische Röhren, Publisher: Hüithig Verlag, ISBN 3-7785-1645-0. In particular band cathodes, pin cathodes or dispenser cathodes are useful in connection with the present invention. The present invention allows to heat all these different kinds of electrodes with the same type of laser beam heating system. Preferred cathode types according to the present invention are band cathodes and pin cathodes.

Figure 14:
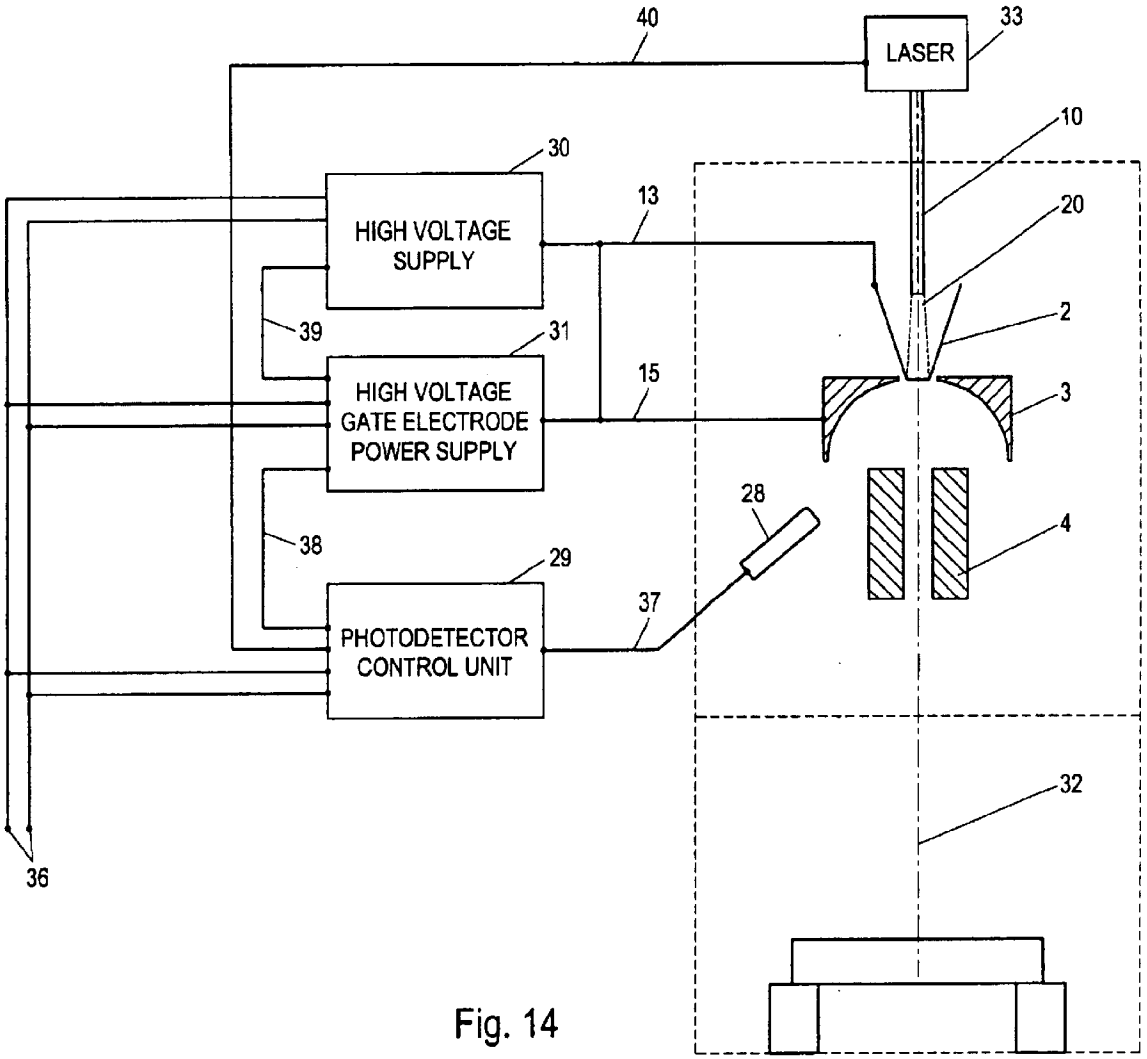
FIG. 14 is a vertical sectional view of a diagram showing an electron gun having a control system for all components to be controlled electrically.
Figure 15:
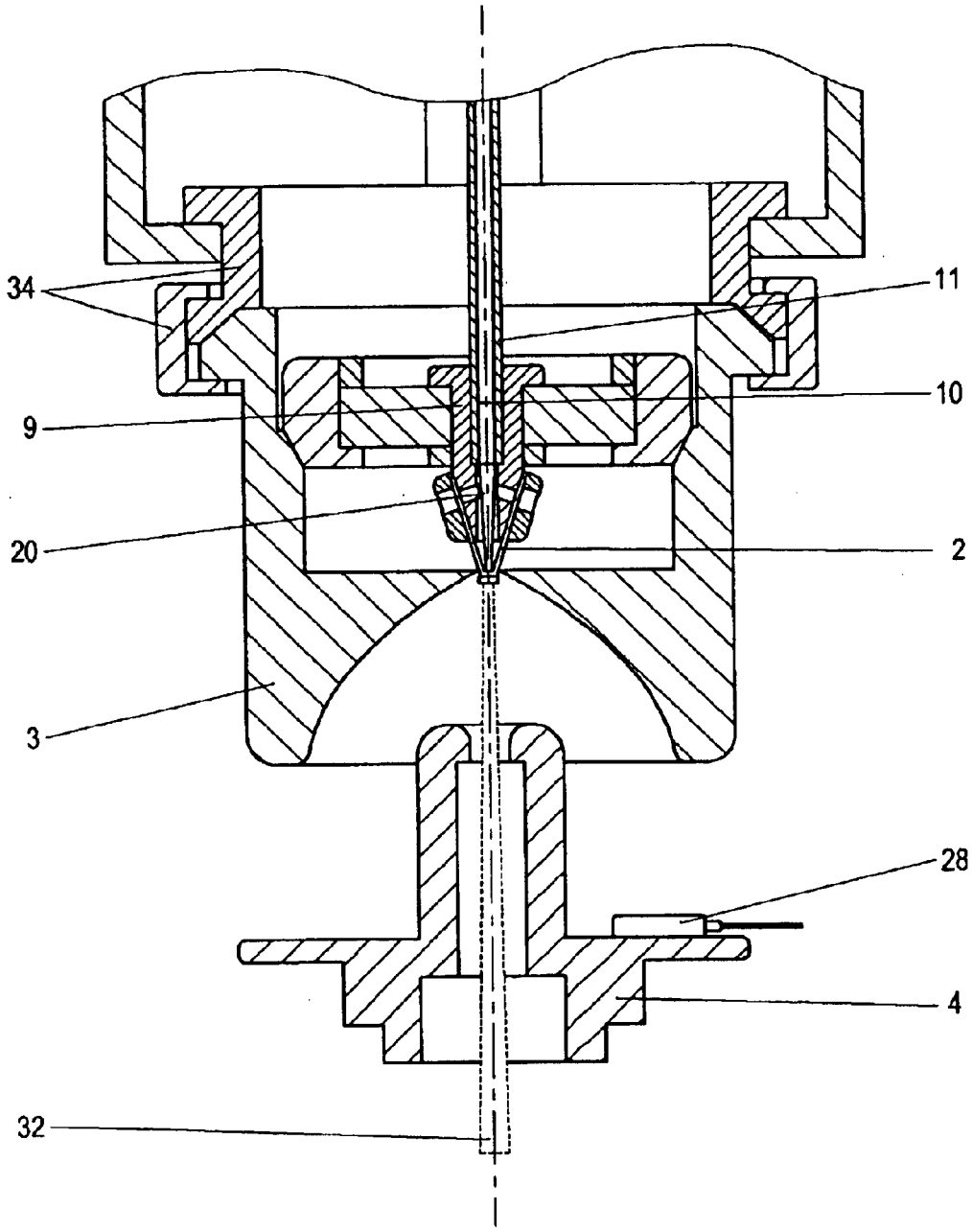
FIG. 15 is a vertical sectional view of a diagram showing an electron gun and showing the emitted electron beam.
Figure 15A:
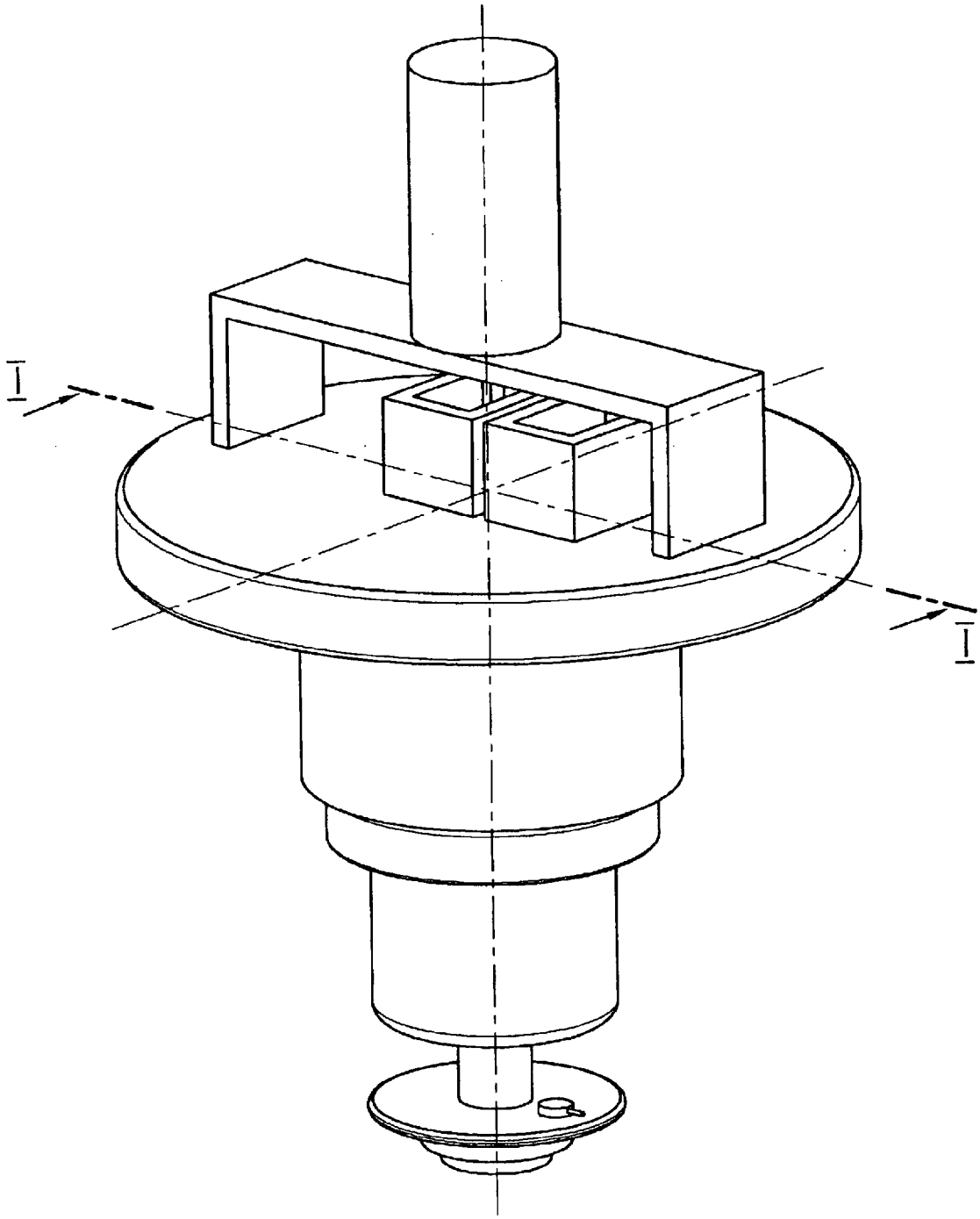
Figure 16:
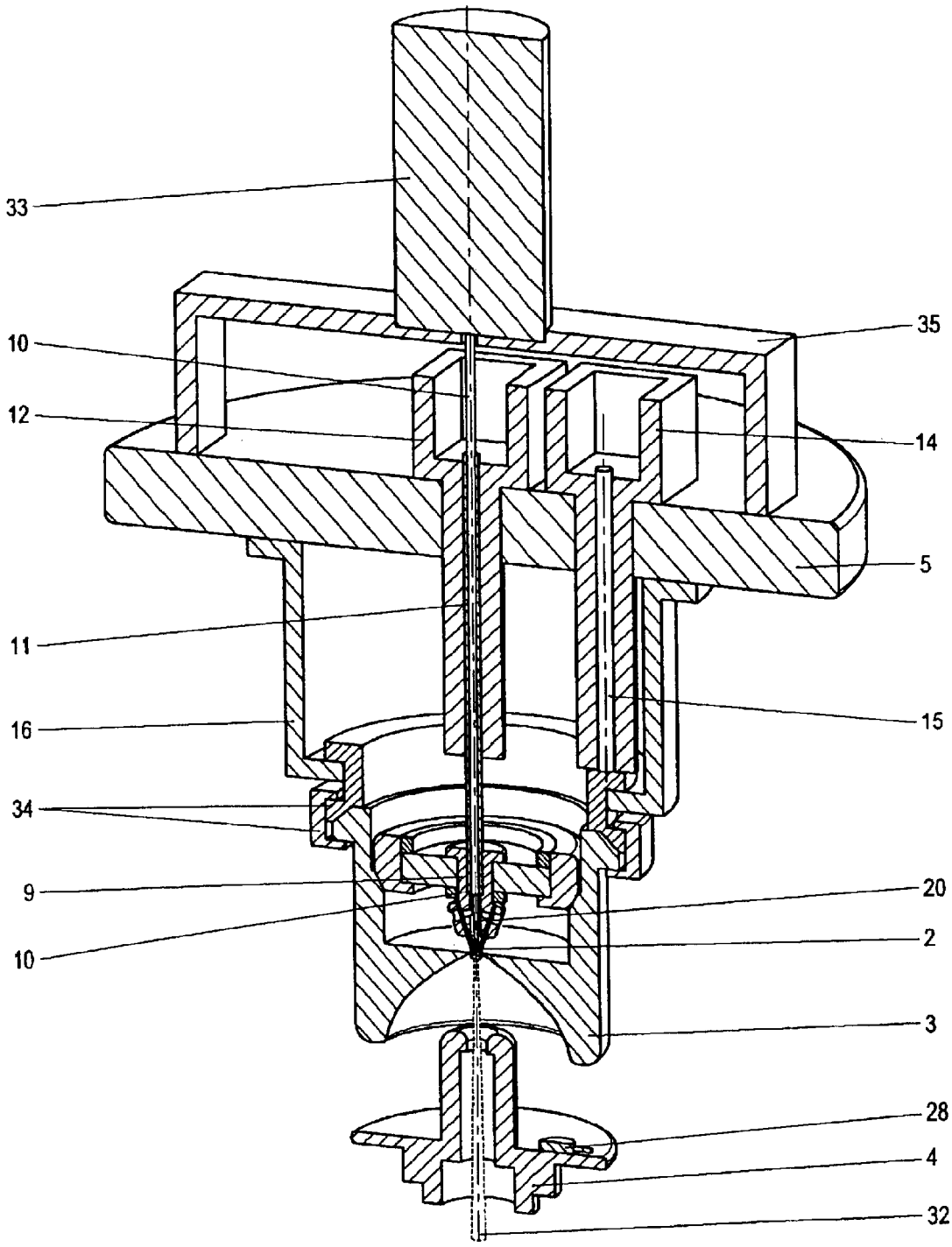
FIG. 16 is a perspective and in part sectional view of an electron gun together with the emitted electron beam.
Figure 17:
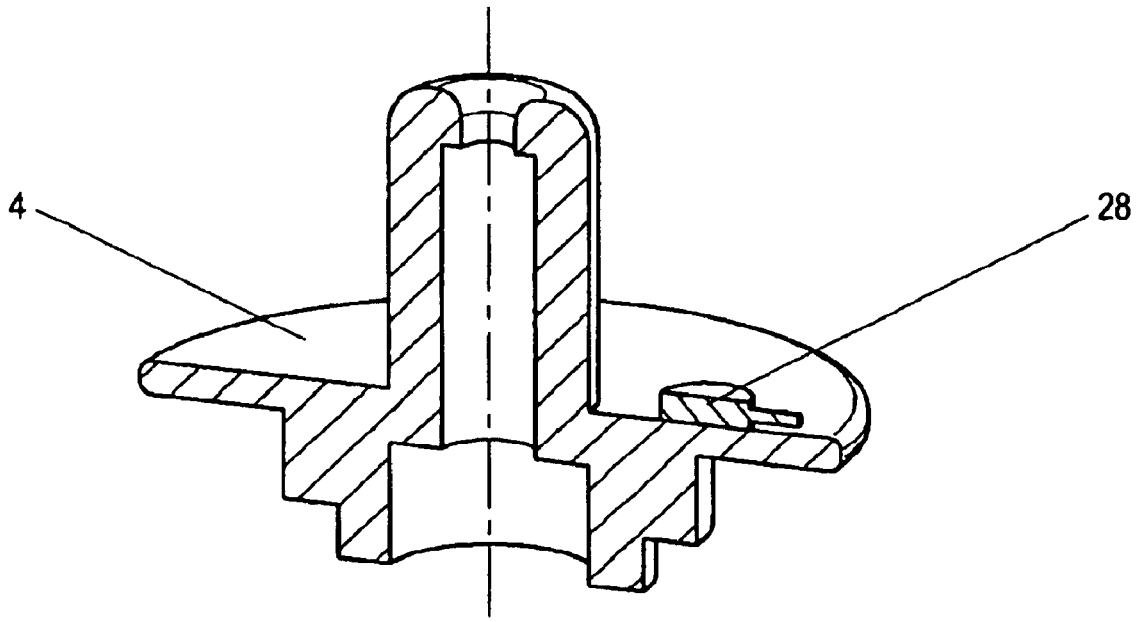
FIG. 17 is a perspective view of a diagram showing an anode with integrated photodetector.

The electron gun with an indirectly heated cathode 2, gate electrode 3 and anode 4 mounted in one housing 5 and used for processing workpieces includes at least one solid-state laser 33 and/or at least one optical facility 23,24,25 to decouple laser beams 20 (FIGS. 7–9) is placed opposite at least one surface other than the emission surface of the cathode and within the electron gun 1 in such a way that the cathode is located in the laser beam path (FIGS. 14,16).

At least one solid-state laser 33 and/or at least one optical facility 23,24,25 to decoiple laser beams 20 is placed opposite at least one surface other than the emission surface of the cathode 2 and within the electron gun 1 in such a way that the cathode is located in the laser beam path. Examples for lasers useful in connection with the present invention include gas lasers, crystals with rare earth ions, and semiconductor junction lasers. An example for a gas laser is represented by the $CO_2$ laser. A preferred laser with metal ions is the YAG laser. Semiconductor laser diodes are capable of furnishing high coherent light beam powers.

Figure 12:
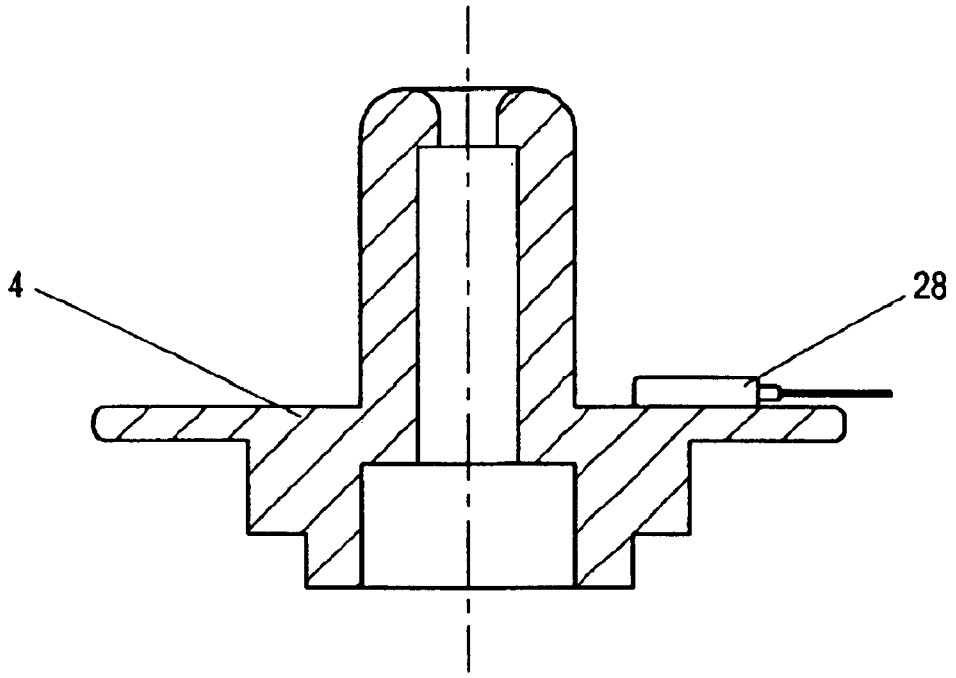
FIG. 12 is a vertical sectional view of a diagram showing an anode with integrated photodetector.

A photodetector, a solid-state image sensor 28, or an optical fiber waveguide 37 connected to a photo detector or solid-state image sensor is placed opposite an additional surface or to the anode 4 (FIG. 12). At least the laser diode or the facility generating laser beans and/or the photodetector or the solid-state image sensor is interconnected with a control unit or a closed-loop control system 29 (FIG. 14).

Figure 4:
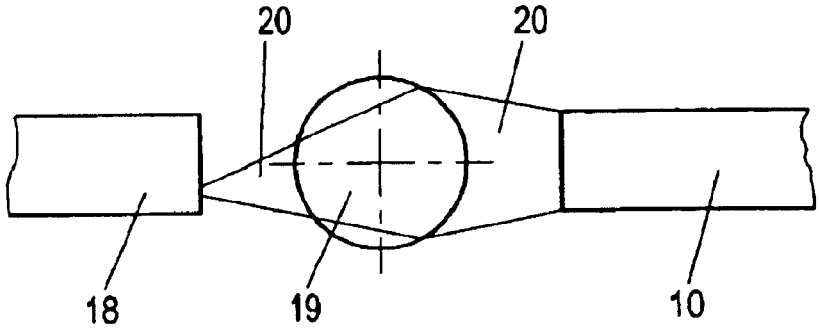
FIG. 4 is a view of a diagram illustrating a coupling of a laser diode to an optical fiber using a spherical lens.
Figure 5:
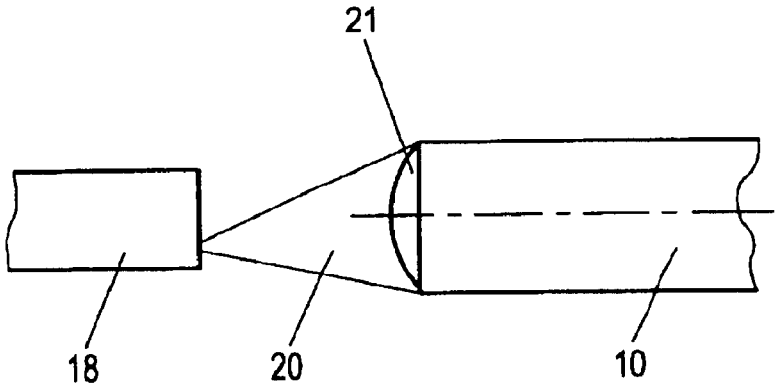
FIG. 5 is a view of a diagram showing a coupling of a laser diode to an optical fiber using a melted-on or integrally cast half sphere.
Figure 6:
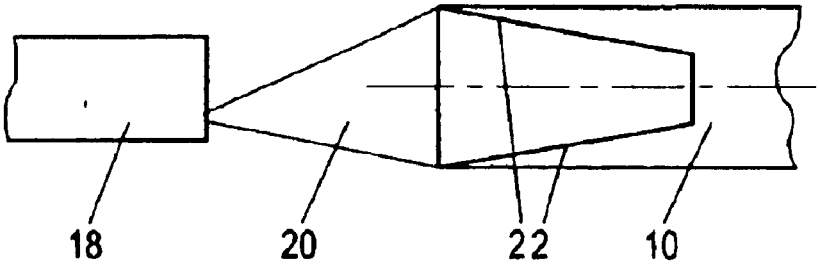
FIG. 6 is a view of a diagram showing a coupling of a laser diode to an optical fiber using a beveling in the optical fiber.
Figure 7:
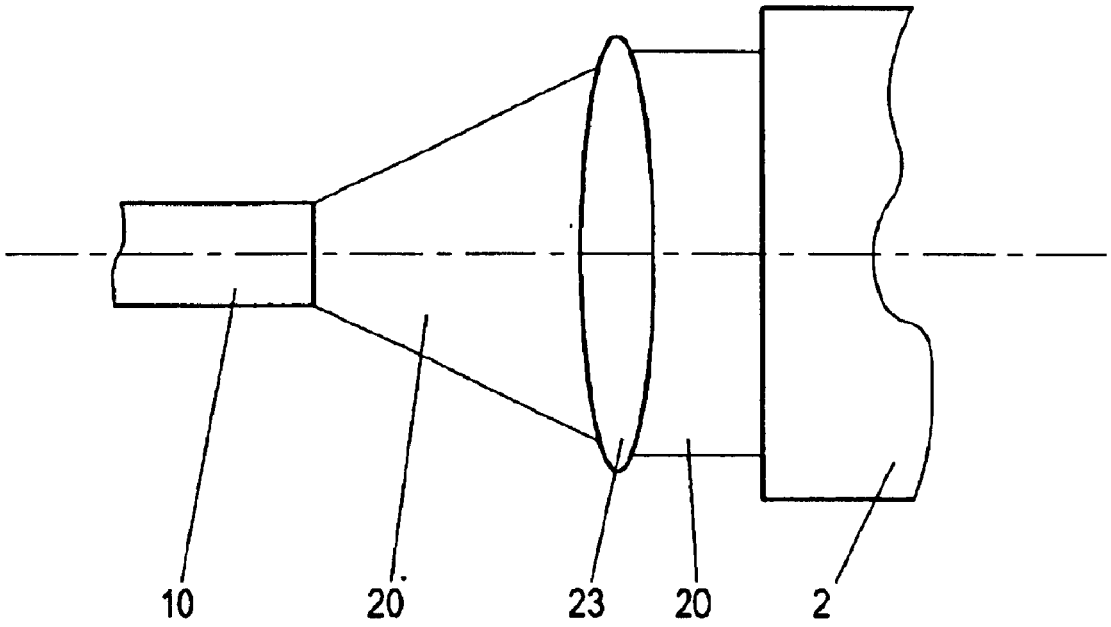
FIG. 7 is a side elevational view of a diagram showing a first end of the optical fiber and a lens that Collimates laser beams.
Figure 8:
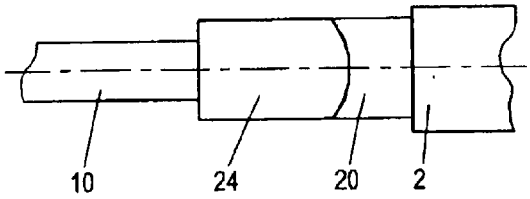
FIG. 8 is a view of a diagram showing a first end of the optical fiber and a bar-type lens that collimates laser beams.
Figure 9:
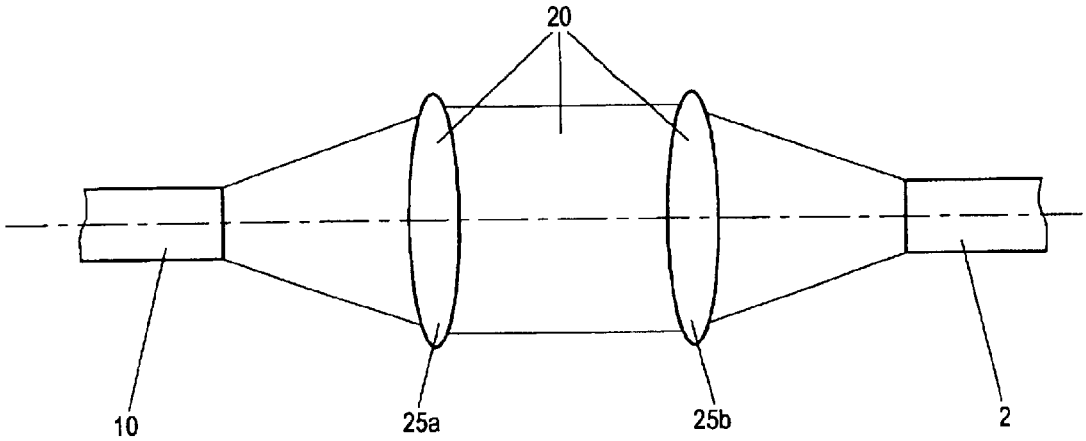
FIG. 9 is a view of a diagram showing a first end of the optical fiber and two successive lenses focussing a laser beam.

The optical facility to decouple laser beams 19,21,22 is optically connected with a laser beam 20 generating facility via at least one optical fiber 10 (FIGS. 4–6). The facility generating laser beams is placed outside the electron gun of The optical fiber 10 is located in a waveguide 11. The waveguide 11 has a direct electroconductive connection to the cathode via at least one part of the cathode anchor 9 (FIG. 15). The waveguide 11 is a component of a high-voltage plug 12 (FIG. 16). A first end of said waveguide 11 is placed outside the housing 5 of the electron gun 1 and its second end is close to the cathode or inside the cathode anchor. The waveguide 11 has an electroconductive connection to a power supply unit for the cathode 30 (FIG. 14). The facility generating the laser beams is a solid-state laser. The facility generating the laser beams is further connected to the optical fiber 10 directly, via a spherical lens 19, a half sphere 21, a taper, or a two-sided beveling of the optical fiber 10 (FIGS. 4–6). The optical facility to decouple laser beams is connected via a fiber laser to a light beam generating facility that functions as a pumping source. The optical facility to decouple laser beams is comprised of the end of at least one optical fiber 10, a half sphere paced at the end of said optical fiber 10 (FIG. 5), or at least one lens placed in the downstream beam path from the end of said optical fiber (FIGS. 7–9). The half sphere is melted on or consists of a cast resin.

Figure 10:
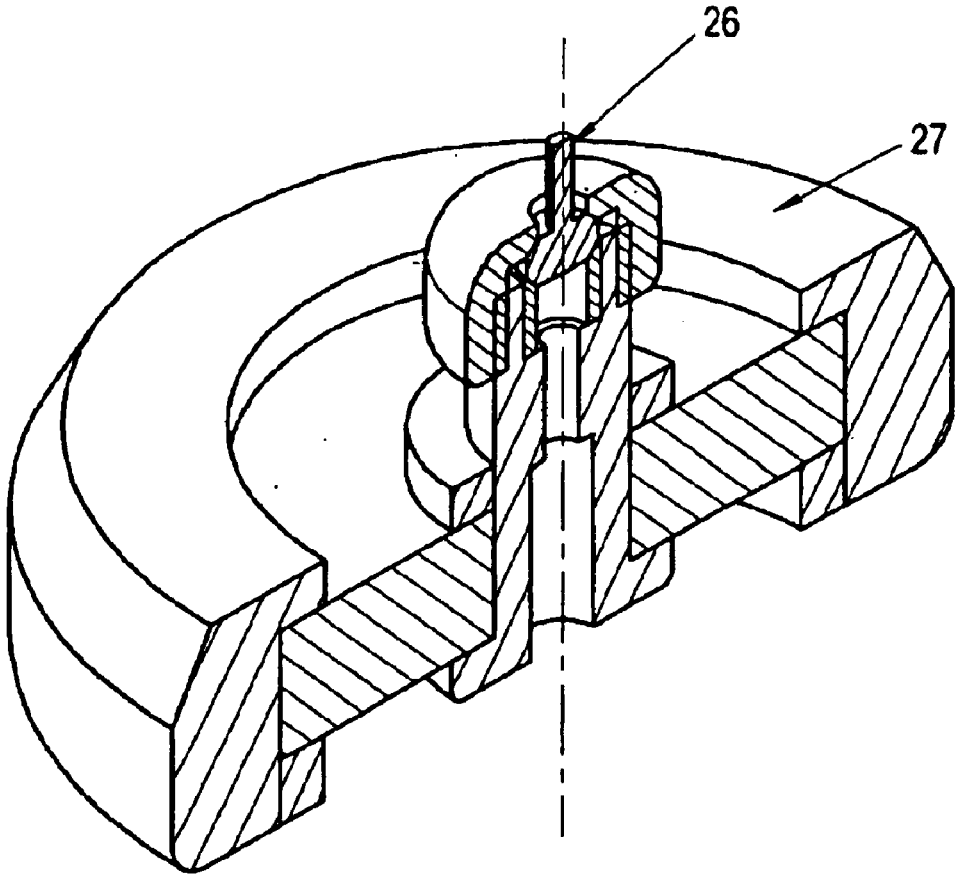
FIG. 10 is a perspective and in part sectional view of a sketch of a body cathode mounted in an appropriate fixing device.
Figure 11:
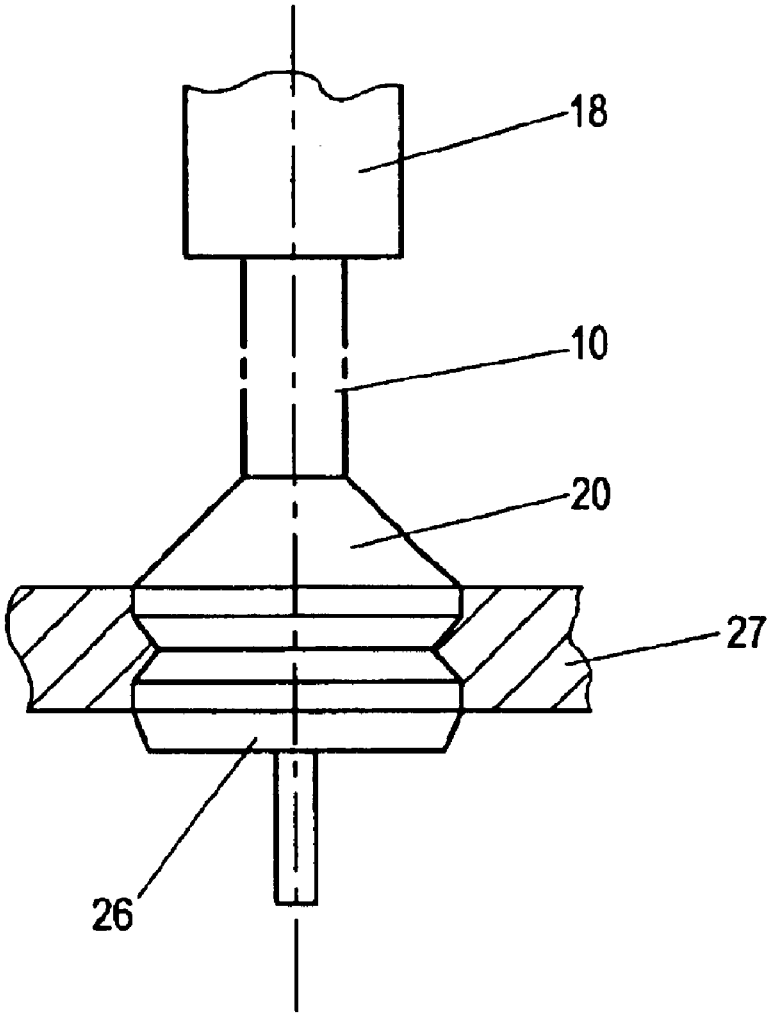
FIG. 11 is a side elevational view of a diagram showing a body cathode and a source of heat consisting of a laser diode with an optical fiber connected to it.

The facility of decouple laser beams is comprised of two lenses (25*a*, 25*b*) placed at a distance to one another (FIG. 9). The cathode is a band cathode 2, a band cathode with an electrode emitting body 8 attached to it (FIG. 3), or a pin cathode 26 (FIG. 11). At least one surface of said pin cathode 26 is comprised of at least one indentation and/or at least one prominence. The electron-emitting surface is circular. The electron-emitting component of the pin cathode 26 is a bolt (FIG. 10). The photodetector or solid-state image sensor 28 and/or the control unit or closed-loop control system 29 are part of the measuring equipment that is used to determine laser power and the resulting cathode temperature (FIG. 14).

EXAMPLE 1

An electron gun 1 comprises an indirectly heated band cathode 2, a gate electrode 3, and an anode 4, and these components are placed sequentially in this order in a housing 5 (FIG. 1). The gate electrode 3 and the anode 4 each have a hole at their center and the electron beam passes through the aligned holes of gate electrode 3 and anode 4. The gate electrode 3, the anode 4 and their electric bonding and disposition are constructed in a conventional way.

Figure 13:
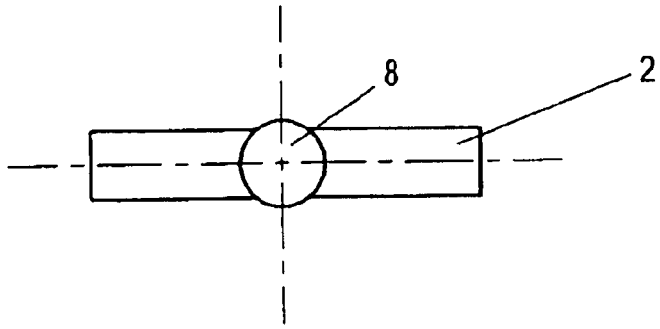
FIG. 13 is a top planar view of a band cathode with a cylindrical body attached to it.
Figure 3:
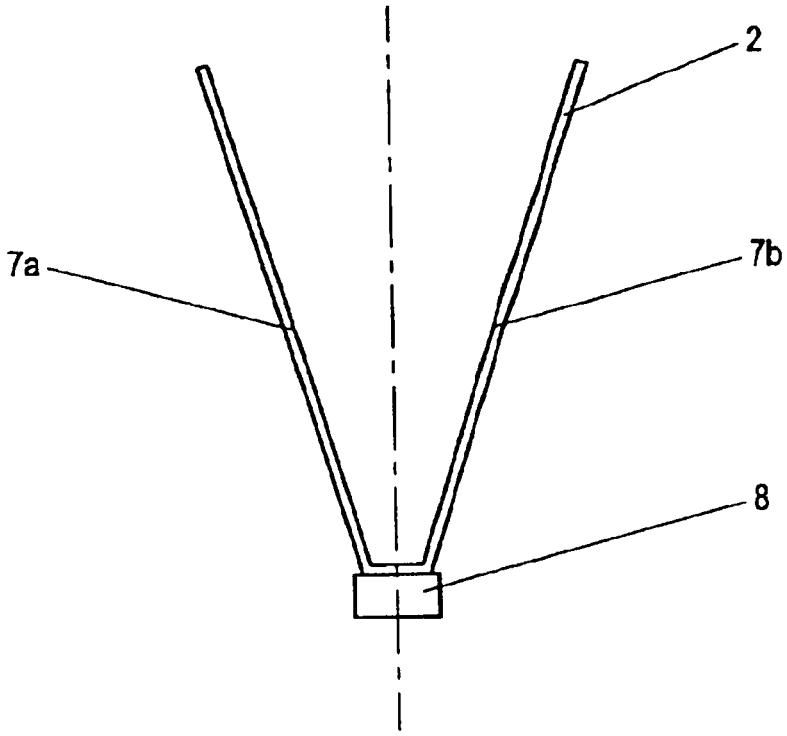
FIG. 3 is a side elevational view of a band cathode with a cylindrical body attached to the band cathode.

The band cathode 2 is U-shaped as shown in FIGS. 3 and 13. A central part 6 of the band cathode 2 is a body which has a square base and two limbs 7*a*, 7*b*, configuring the U-shape. The limbs form an angle of from about 20 to 40 degrees relative to a line perpendicular to the central part 6. A cylindrical body 8 is attached to the surface of the central part 6 on a side of the central part 6 disposed opposite to the limbs 7*a*, 7*b* in such a way that the square surface of said central part 6 and a first upper (FIG. 3) circular surface (compare FIG. 13) of said cylindrical body 8 are interconnected. A second lower (FIG. 3) circular surface of said cylindrical body 8 is the emission surface of the band cathode 2. FIG. 3 shows a band cathode 2 constructed according to these considerations. A special cathode anchor 9 (FIG. 2) supports and guarantees a geometrically stable position of the emission surface in the electron gun 1. At the same time, electric bonding is implemented via the said cathode anchor 9.

The band cathode 2 and the cylindrical body 8 attached to it are made of a material with a high melting temperature, preferably tantalum or tungsten doped with rhenium.

The band cathode 2 is heated indirectly through laser beams that are incident on the open surface of the central part 6 that faces the same side where the limbs 7*a*, 7*b* are disposed. Therefore, the first end of the optical fiber 10 is placed at a spacing from the said surface of the band cathode 2. The first end of the said optical fiber 10 and the surface of said central part 6 of the band cathode 2 are parallel. The optical fiber 10 is a glass fiber.

With such direct coupling of the first end of the said optical fiber 10 and the band cathode 2, problems arising from the high negative potential of band cathode 2 need to be taken into account. The optical fiber 10 is therefore placed in an electroconductive waveguide 11 that also connects the band cathode 2 to a high-voltage generator. The said waveguide 11 is electroconductively connected to the cathode anchor 9. The waveguide 11 and the optical fiber 10 are furthermore components of a first high-voltage plug 12 (FIG. 1). The said waveguide 11 is electroconductively connected to a high-voltage cable 13 in this first high-voltage plug 12. At the same time, the optical fiber 10 is led through the waveguide 11.

A second end of said waveguide is placed and a firstend of said waveguide is disposed at a distance from about 2 to 150 millimeters relative to the cathode or inside the cathode anchor. The waveguide gas an electroconductive connection to the power supply unit for cathode.

A laser diode 18 is optically coupled to a second end of the optical fiber 10. Coupling may either be directly achieved by positioning the output of laser diode 18 and the second end of waveguide 10 next to each other, or by using one of the following ways of coupling:

A. A cylindrical or spherical lens 19 is placed relative to an axis of symmetry in the path of the laser beam 20 between the laser diode 18 and the optical fiber 10 (as shown in FIG. 4).
B. A half sphere 21 melted-on or integrally cast to the second end of optical fiber 10 (as shown in FIG. 5).
C. The second end of optical fiber 10.
D. A beveling 22 into an optical fiber 10 (as shown in FIG. 6).

The laser diode 18 is mounted in an appropriate anchor. The anchor and laser diode 18 are either located at the outer wall of the housing 5 of the electron gun 1, or in a separate housing outside the electron gun 1.

The gate electrode 3 is connected to a gate control voltage through a second high-voltage plug 14 (FIG. 2) by integrating an electric cable 15 in such a way that said cable 15 and said gate electrode 3 are in galvanic contact.

The high-voltage plugs 12, 14 are fitted airtight into the housing 5 of the electron gun 1. The band cathode 2 and the gate electrode 3 are connected to the appropriate gate drive units through the high-voltage plugs 12, 14. The gate drive units can be interconnected with a control unit.

The gate electrode 3 and the cathode anchor 9 and band cathode 2 are mounted to the housing 5 of the electron gun 1 using an insulator 16. A flange 17 of the electron gun 1 allows to mount the electron gun 1 to a valve or other components.

The type of optical coupling between the first end of optical fiber 10 and the surface of the central part 6 of the band cathode 2 towards the limbs 7*a*, 7*b* can be one of the following constructions:

A. By using a lens 23 collimating the laser beams 20 that is placed at a spacing to, and relative to an axis of symmetry with, the first end of said optical fiber 10 (as shown in FIG. 7).
B. By using a bar-type lens 24 collimating the laser beams 20 that is directly connected to, and placed relative to an axis of symmetry with the first end of the optical fiber 10 (as shown in FIG. 8).
C. By using two successive lenses 25*a*, 25*b* that first collimate, then focus the laser beams 20 and are placed relative to an axis of symmetry (as shown in FIG. 9).

The first end of the optical fiber 10 and the collimating lens 23, the collimating bar-type lens 24, or the collimating and focusing lenses 25*a*, 25*b* are mounted in fixing devices that match their geometries and are not shown. These anchors are mounted to a section of the cathode anchor 9, an inner surface of the housing 5 of the electron gun 1 and/or the insulator 16 via at least one structural element.

EXAMPLE 2

The electron gun of this example comprises an indirectly heated cathode, a gate electrode and an anode, and these components are placed successively in a housing. The gate electrode and the anode each have a hole at their center through which the electron beam passes. The gate electrode, the anode and their electric bonding are constructed in a conventional way. The overall construction is similar to the first example except for the cathode.

The cathode of the second example comprises two cylindrical parts. The cross section of the first part is greater than that of the second part. Both parts constitute the body cathode 26 (FIG. 10). Thus the body cathode 26 consists of two circular surfaces with differing diameters that are placed parallel to one another. FIG. 10 shows such a body cathode 26 in a fixing device 27. The fixing device 27 is made of a material with a high melting point. The material may be tantalum, tungsten, or tungsten alloyed with rhenium.

According to another embodiment of the said body cathode 26 the larger part is comprised of a V-shaped groove and this type of body cathode is shown in FIG. 11, wherein the V-shaped groove is cut into a lateral surface of the body cathode 26.

The body cathode 26 is placed in a cathode anchor 27. A hole of the cathode anchor 27 matches with and is aligned with the diameter of the larger part of the body cathode 26. In its simplest configuration, said cathode anchor 27 is a hollow cylinder with two holes that have different diameters. This anchor 27 fully encompasses the larger part of the body cathode 26 (as shown in FIGS. 10 and 11).

A circumferential prominence in one of the holes is designed in such a way in a further embodiment that it engages in the V-shaped groove of the body cathode 26. This supports the cathode and guarantees the cathode to be held in a firm position in the electron gun so that it cannot slip from the cathode anchor 27 (as shown in FIG. 11). The cathode anchor 27 consists preferably of two parts, its plane of section running through its axis of symmetry. As the two parts are separate, the body cathode 26 can be easily inserted into the cathode anchor 27, and a used up cathode can easily be removed. A cathode anchor 27 designed in this way has the advantage that it does not cover the circular surfaces of the body cathode 26 and allows a convenient replacement of the body cathode 26. The cathode anchor 27 at the same time includes or represents an electric contact so that an electric voltage is applied to the body cathode 26.

The smaller circular surface of the body cathode 26 is the emission surface. It faces the gate electrode and anode of the electron gun 1.

The body cathode 26 is heated indirectly via laser beams 20 that are incident on the larger circular surface. For this purpose, an optical fiber 10 is placed at a spacing above the larger circular surface of the body cathode 26. It is a glass fiber. The type of optical coupling between the first end of optical fiber 10 and the larger surface of the body cathode 26 can be as follows:

A. Direct coupling, so that the first end of the optical fiber 10 is placed at a spacing to the larger circular surface of the body cathode, and the end surface of the optical fiber 10 and the larger circular surface of the body cathode 26 being arranged in parallel (as shown in FIG. 11),
B. Use of a lens 23 (FIG. 7) collimating the laser beam 20, wherein the lens 23 is placed at a spacing to, and relative to an axis of symmetry with, the first end of said optical fiber 10 (as shown in FIG. 7).
C. Use of a bar-type lens 24 (FIG. 8) collimating the laser beam 20, wherein the bar-type lens 24 is directly connected to, and placed relative to an axis of symmetry with, the first end of the optical fiber 10 (as shown in FIG. 8).

D. Use of two successive lenses 25*a*, 25*b* (as shown in FIG. 9), wherein the two successive lenses 25*a*, 25*b* first collimate, then focus the laser beam 20 and are placed relative to an axis of symmetry between the first end of optical fiber 10 and the larger circular surface of the body cathode 26.

The first end of the optical fiber 10 and the collimating lens 23, the collimating bar-type lens 24, or the collimating and focusing lenses 25*a*, 25*b* are mounted in fixing devices that match their geometries and are not shown. These anchors are mounted to a section of the cathode anchor 9, an inner surface of the housing 5 of the electron gun 1 and/or the insulator 16 via at least one structural element.

In case of a direct coupling of the first end of the said optical fiber 10 and the body cathode 26, problems arising from the high negative potential of body cathode 26 should be taken into account. The optical fiber 10 should therefore be connected to the potential of body cathode 26 at the end pointing towards the body cathode 26. In addition, the optical fiber 10 is placed in a waveguide as described in the Example 1.

A laser diode is optically coupled to the second end of the optical fiber as described in the Example 1.

EXAMPLE 3

The 3. example follows to the features of the 1. and 2. examples.

A solid-state laser in the form of at least one laser diode is located in the electron gun instead of an optical fiber, and a laser diode is located outside the electron gun. The solid-state laser is both a pulse-type and a continuous-wave laser (cw laser). Such solid-state lasers are characterized by high radiation output, good radiation focusing, stable spatial and spectral distribution of radiation, long service life (104 to 105 hours), and low degradation (drop in light output with increasing service life).

The laser diode is placed in the housing of the electron gun so that the emitted laser beams are incident on the surface of the central part facing the limbs of the U-shaped band cathode or on the larger circular surface of the body cathode. The laser diode and its fixing device are mounted to a section of the cathode anchor or to an inner surface of the housing of the electron gun via at least one structural element.

The spacing between this surface and the laser diode is determined by the emission characteristics of the laser diode. In general, the emission curve has the shape of a club with different vertical and horizontal angles of beam spread. The surfaces of the cathode are placed within this club-shaped emission in such a way that the cross section of the laser radiation is smaller than the central part of the band cathode or the larger circular surface of the body cathode.

All electric cables for operating the electron gun are directly led through the housing to the outside via high-voltage plugs, and are connected to the respective gate drive units. The gate drive units themselves can be interconnected to a control unit.

EXAMPLE 4

Except for the implementation of the optical fiber, the layout and positioning of the components of the electron gun in this 4. example are similar to those of the first and second examples.

The indirectly heated cathode, gate electrode and anode are placed in this sequential order in the housing of the electron gun (as shown in FIG. 1).

The optical fiber in this embodiment is a fiber laser. The laser diode in this embodiment is a pumping source for the said fiber laser. The laser beams are coupled from the laser diode into the fiber laser as described in the first and second embodiments.

The fiber laser is a monomode glass fiber doped with erbium atoms. These form a 3-level system, that can be pumped to a metastable laser level using infrared light of the wavelengths 980 nm or 1480 nm.

The pumped beams are coupled from the laser diode into the fiber laser as described for coupling in laser beams in the first and second embodiments.

Optical coupling between the first end of the optical fiber and the cathode is as described for the first or second embodiments.

The optical components are mounted in appropriate fixing and support devices that may be placed and attached either inside or outside the housing as described for the first and second embodiments.

EXAMPLE 5

The layout of the electron gun 1 in this fifth example is similar to that of the first to fourth examples (as shown in FIGS. 1 to 11).

In addition to the characteristics of the first to fourth examples, a first end of a second optical fiber 37 is placed at a spacing from and pointing towards one surface of the cathode (as shown in FIG. 12), a photodetector and a solid-state image sensor are located in the anode 4.

The surface of the photodetector that is sensitive to electromagnetic radiation points to the emission surface of the cathode. The photodetector can be a photoresistor, a photodiode, or a phototransistor. They all are characterized in that they change their electric current or voltage dependent upon the intensity of incident electromagnetic radiation. The absolute value of the electric current or voltage is equivalent to the temperature of the cathode.

The sensitivity of the photodetector for electromagnetic radiation is in visible range and at adjacent wavelengths in the infrared and ultraviolet ranges. It is selected in such a way that the wavelength ranges of the photodetector and the laser differ. The cathode radiates additionally light at certain wavelengths and the intensity of the light depends on the temperature of the cathode. The radiation of the cathode can occur both in the infrared and in the ultraviolet region of the spectrum. By measuring the radiation at a certain wavelength or at a plurality of wavelengths, this will allow to determine the temperature of the cathode. Thus an electromagnetic radiation corresponding to the indirectly heated cathode is measured by the photodetector so that a unique cathode temperature measurement is guaranteed.

The electric current or voltage equivalent to the temperature is amplified by an electronic amplifier so that it can be further processed or displayed. The type of amplifier used should preferably be at least one operational amplifier.

The solid-state image sensor is a linear or two-dimensional matrix-shaped arrangement of optoelectronic semiconductor elements operating as photoelectric receivers. Each of these elements is connected to a charge-coupled memory and allows decomposition of the image of the heated cathode. The elements are facing one cathode surface. The cathode image taken is converted into electric signals and digitally processed and stored in a microcomputer or computer outside the housing. The outcome is a color or black-and-white photograph that can be associated with temperatures. The colors of a color photograph or greyscale values of a black-and-white photograph can be assigned to different temperatures. Thus the temperature of the total cathode surface recorded can be measured. This temperature measurement corresponds to the temperature distribution across the emission surface of the cathode. This temperature distribution can be related to radiation distribution and intensity when focusing, in particular, on larger cathodes. This allows better focusing in space charge operation with high-duty electron beams.

The second end of the other optical fiber 27 is optically coupled to a photodetector or image sensor.

EXAMPLE 6

The construction of the electron gun 1 in this 6. example is similar to the construction of the first to fifth examples (as shown in FIGS. 1 to 12).

The sixth example shall be explained in greater detail below based on the first embodiment, in particular, FIG. 2.

A microcomputer or computer is the control unit 29 to which either the photodetector 28 is connected via an amplifier and an analog-digital converter or the image sensor 28, respectively. The laser diode 18 is also connected to the microcomputer or computer. Thus the temperature of the band cathode 2 can be controlled through the intensity of the laser diode 18 so that an electron beam is available for machining the workpiece at approximately constant and/or presentable conditions.

According to a further embodiment similar to that just recited in example 6, the power supplying units of the band cathode (30) and the gate electrode (31) are connected to the microcomputer or computer via a gate terminal. Thus all components of the electron gun 1 of the invention that can be electrically influenced are controlled using the microcomputer or computer as control system 29. FIG. 13 shows a block diagram.

According to a further embodiment, the shape of the cathode described can be used alternately in other embodiments for cathode heating and/or a temperature measuring device and control logic can be correspondingly installed.

According to FIG. 14, the electron gun 1 in this 6. example is constructed similar to the one of the first to fifth examples (as shown in FIGS. 1 to 12). The sixth example is explained in greater detail below based on the first example, by way of in particular, FIG. 14.

A microcomputer or computer (MITSUBISHI or INTEL) is the control unit 29 to which either the photodetector 28 is connected via a feed back signal 37 to an amplifier and an analog-digital converter or the image sensor 28, respectively. Based on stored operation characteristic, a logic calculation inside the control unit 29 will provide a set value for the laser power 40 and a compensation value 38 for the gate electrode power supply 31. The gate electrode power supply 31 integrates both the signal of the temperature of the cathode 38 and the signal of the feed back 39 of the current of the electron beam provided from the high voltage power supply 30. This integration is also based on operational characteristics and will end in providing an optimal gate voltage 15 setting. Therefore the temperature of the band cathode 2 or body cathode 26 can be controlled through the intensity of the laser diode 18 or laser 33 such that an electron beam 32 is available for machining the workpiece at approximately constant and/or presentable conditions.

EXAMPLE 7

This example refers to a preferred embodiment employing a band cathode. A 16 Watt fiber coupled laser diode system emitting coherent light radiation at a wavelength of 808 nanometers is employed. The wavelength is adjustable to match the optical properties of different cathode materials. Such fiber couples laser diode systems and fibers are commercially available from Power Technology Inc., Little Rock, Ark. (www.powertechnology.com). The fiber is integrated in the high voltage plug 12 (FIG. 1). The laser is adjustable in its output power from 0 to 16 Watts. The power control of the laser diode can be a feedback circuit employing a signal derived from a sensor of the cathode emission temperature (working temperature).

The band cathode can have a total length of from about 8 to 20 millimeters and a width of from about 0.5 to 10 millimeters. The emission length is substantially equal to the width of the cathode. The dimensions of the emission body of the band electrode can be a diameter of from about 0.7 to 4 millimeters, and a height of from about 0.5 to 1.5 millimeters.

EXAMPLE 8

A pin cathode as shown in FIG. 10 is employed in this example. A pin cathode 26 is shown in a sectional view in FIG. 10 together with tensioning unit. The illustration in FIG. 10 is a top-down illustration furnished for better recognition purposes. The top side of FIG. 10 corresponds to the bottom side of FIG. 1 and vice versa. The tensioning unit shown in FIG. 10 tensions the pin cathode 26 in the cathode anchor 27. The pin cathode 26 is furnished with a larger circular or cylindrical body having a diameter from about 6 to 15 millimeters. The larger circular or cylindrical body is employed as a tensioning unit. The emission surface is the somewhat smaller circular or cylindrical body having a diameter of from about 5 to 14 millimeters.

The coupling of the laser beam irradiation 20 to the pin cathode 26 is illustrated in FIG. 11. The same pin cathode is employed in both FIGS. 10 and 11. A fiber coupled laser diode system emitting coherent light radiation at a wavelength of 808 nanometers is again employed for irradiating a pin cathode. However a higher output power of the laser diode of from about 50 to 100 Watt is used in connection with a pin cathode. The pin cathode is sometimes also called a body cathode.

Figure 18:
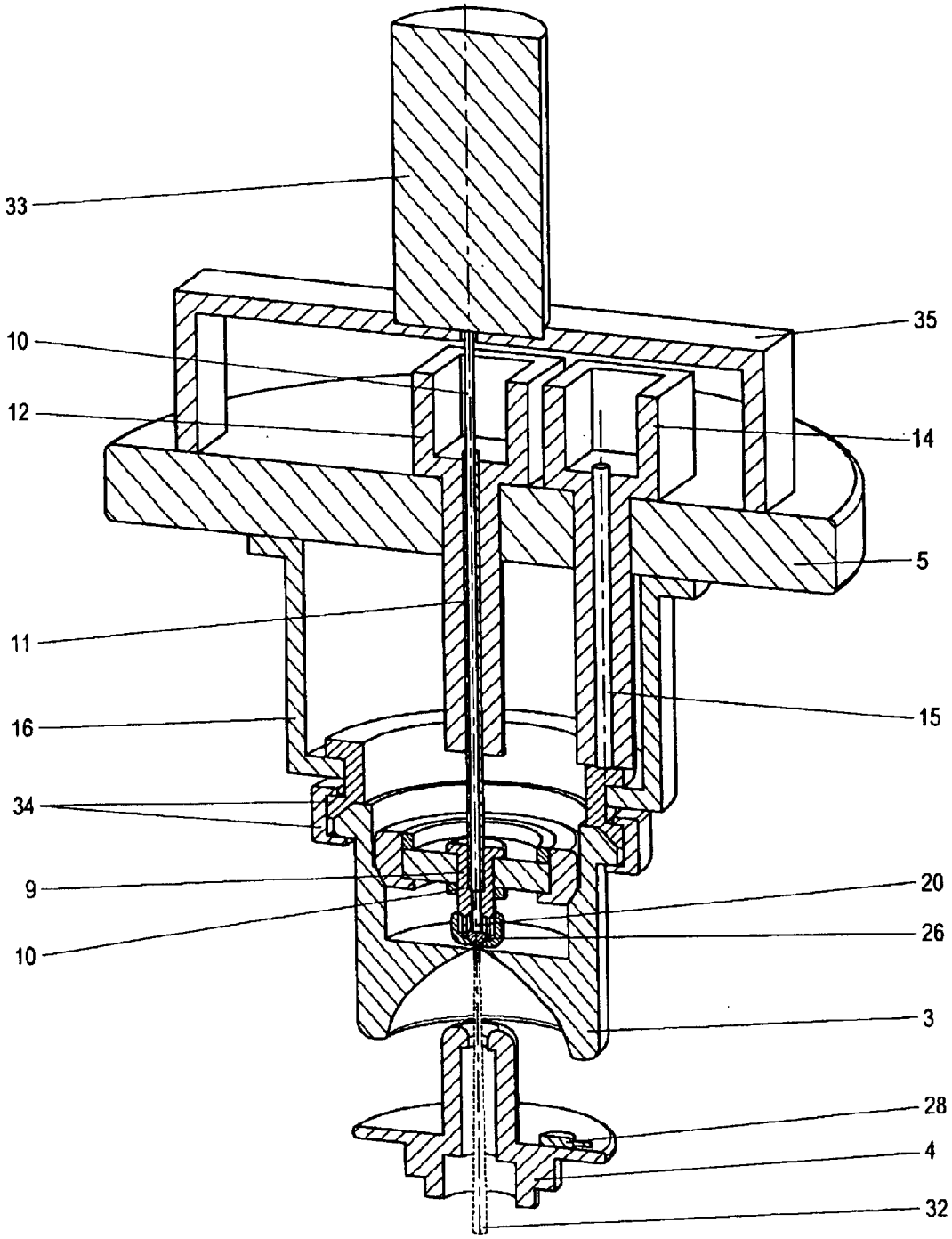
FIG. 18 is a perspective view of an electron gun having a pin electrode.
Figure 19:
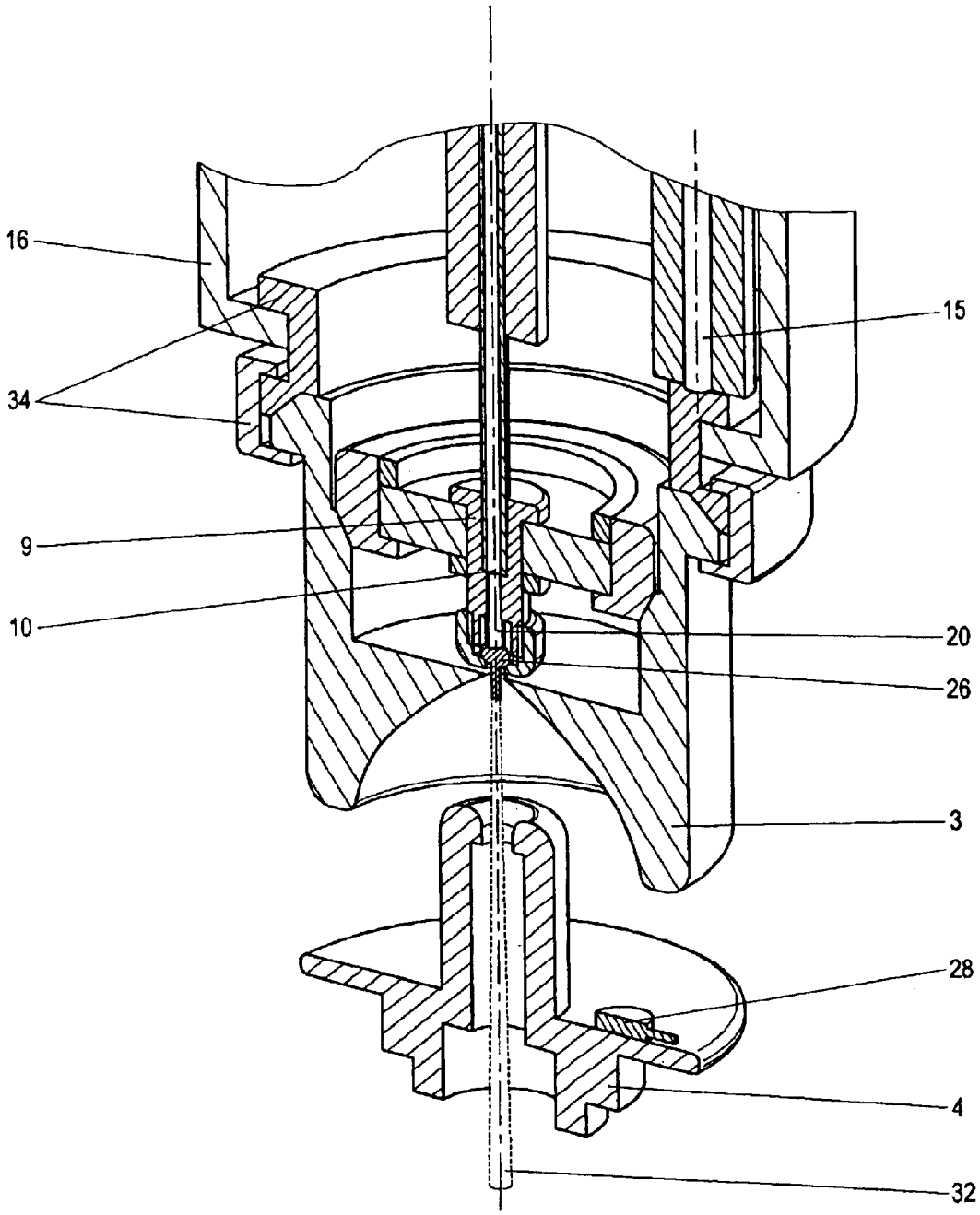
FIG. 19 is an enlarged perspective view of the electron gun of FIG. 18 in the area of the electron acceleration.
Figure 20:
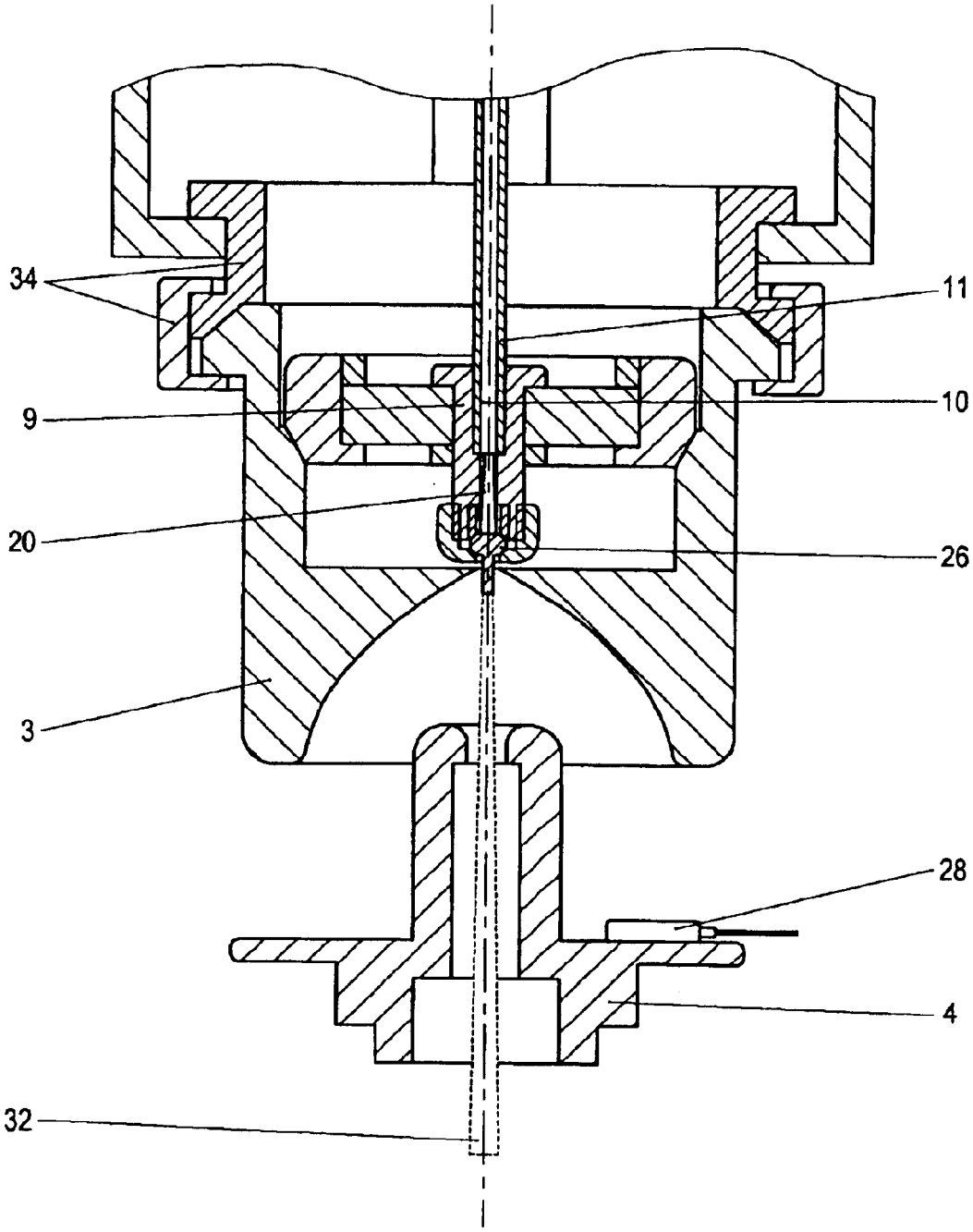
FIG. 20 is a sectional view of an electron gun having a pin electrode.
Figure 21:
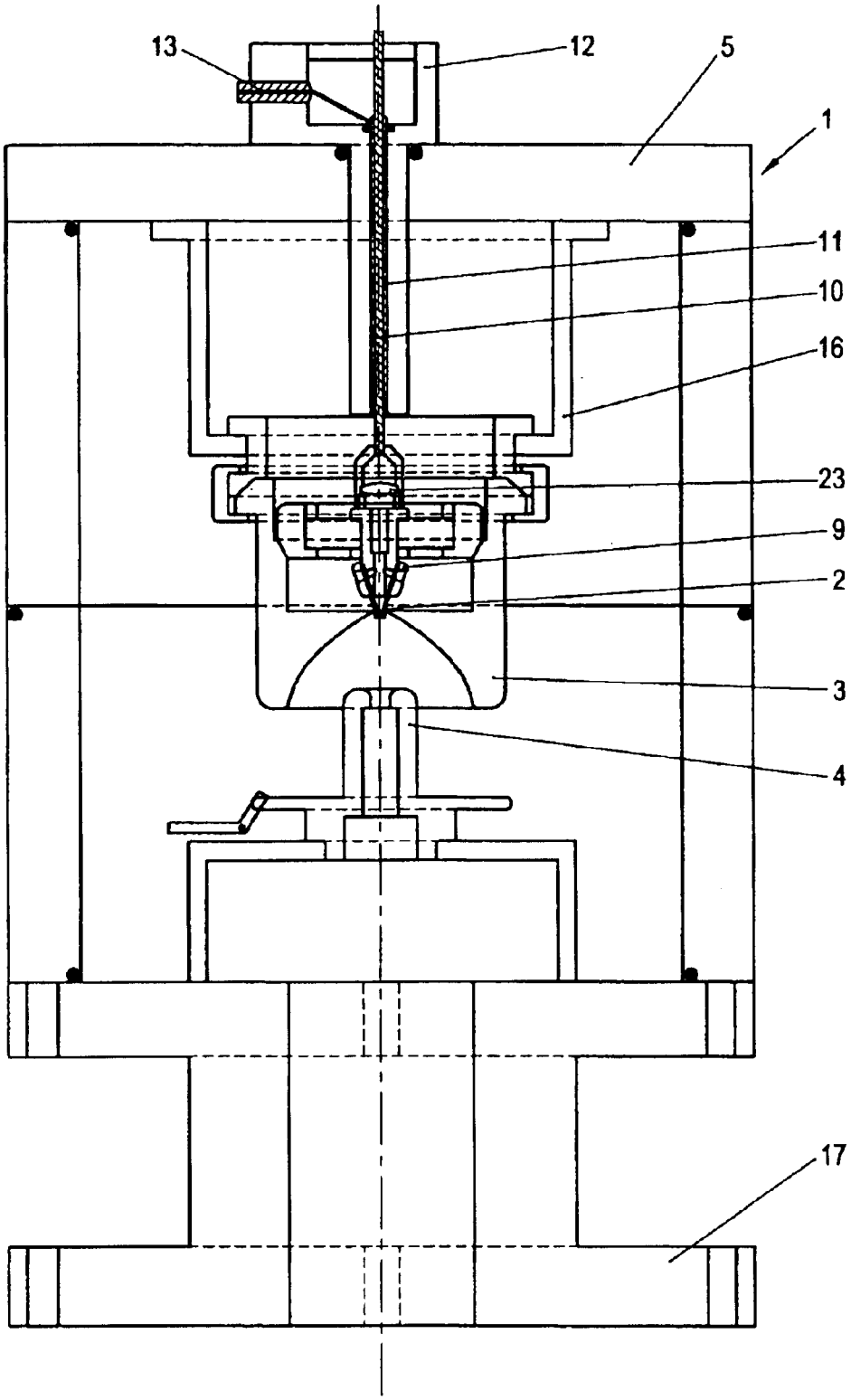
FIG. 21 is a vertical sectional view of a schematic diagram showing a vertical section of an electron gun with a band cathode and showing a laser beam focusing device.
Figure 22:
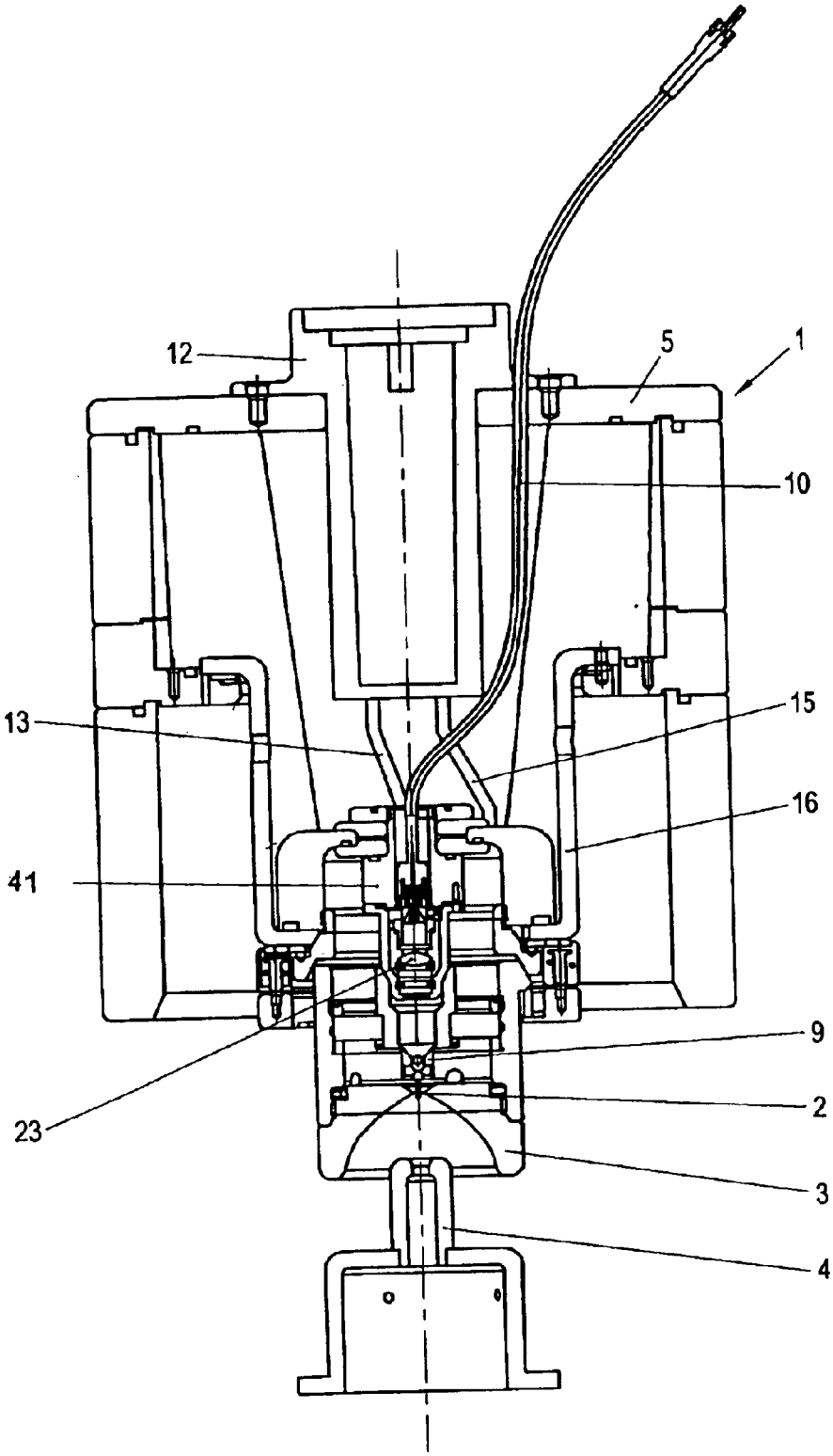
FIG. 22 is a vertical sectional view of a schematic diagram showing another vertical section of an electron gun with a laser beam focusing device.

FIG. 18 shows the overall construction of the electron gun with pin cathode. The construction of FIG. 18 is like that of FIG. 16 showing the band cathode with the exception of the cathode support. The present invention is associated with the advantage that the same construction of the electron gun can be employed be it for a band cathode or a pin cathode and the two types of electron guns are only distinguished by an exchangeable cathode support and an exchangeable cathode. Thus the determination of what kind of electrode will be employed in the electron gun can be made after the apparatus of the electron gun has been installed.

It will be understood that each of the elements described above, or two or more together, may also find a useful application in other types of electron gun system configurations and cathode emission processes differing from the types described above.

While the invention has been illustrated and described as embodied in the context of a laser based electron gun, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

REFERENCE NUMERAL—DESCRIPTION

1—gun
2—band cathode
3—gate electrode (grid voltage, bias cap)
4—anode
5—gun housing
6—central part of band cathode
7*a*—limb of band cathode
7*b*—limb of band cathode
8—emission surface
9—Cathode anchor band cathode (integrating the connection for Waveguide and accelerating voltage to cathode)
10—optical fiber for laser beam transmission
11—waveguide
12—high voltage plug with integrated optical fiber 10
13—high voltage cable
14—high voltage plug contacting gate electrode 3
15—high voltage cable for gate electrode 3
16—high voltage isolator
17—adapter flange
18—Laser diode
19—spherical lens
20—Laser beam
21—halt sphere fiber
22—beveling
23—collimating lens
24—bar type lens
25*a*—successive lens
25*b*—successive lens
26—body cathode (Pin Cathode)
27—Cathode anchor body cathode (integrating the connection for Waveguide and accelerating voltage to cathode)
28—photodetector
29—control unit for photodetector and laser beam regulation
30—high voltage supply (accelerating voltage)
31—power supply for gate electrode
32—electron beam
33—Laser
34—bayonet joint
35—Laser support
36—AC stabilized power service
37—feed back photodetector
38—set value for cathode temp
39—feed back electron beam current
40—set value for laser power

What is claimed is:

1. An electron gun comprising a housing;

a cathode having an emission surface on a first side and an irradiation surface on a second side of the cathode disposed opposite to the first side and said cathode being mounted in the housing;

a gate electrode disposed adjacent to the cathode for controlling the beam of electrons emitted by the cathode and mounted in the housing;

an anode mounted in the housing and disposed at an appropriate distance from the cathode for building up a voltage between cathode and anode and for accelerating electrons emitted by the cathode;

a source of a laser beam for directing a laser beam to the irradiation surface of the cathode.

2. An electron gun comprising a housing;

a cathode having an emission surface on a first side and an irradiation surface on a second side of the cathode disposed opposite to the first side and said cathode being mounted in the housing;

a gate electrode disposed adjacent to the cathode for controlling the beam of electrons emitted by the cathode and mounted in the housing;

an anode mounted in the housing and disposed at an appropriate distance from the cathode for building up a voltage between cathode and anode and for accelerating electrons emitted by the cathode;

a source of a laser beam for directing a laser beam to the irradiation surface of the cathode;

wherein the source of the laser beam is a member selected from the group consisting of solid-state laser, an optical facility to decouple laser beams and combinations thereof;

wherein the source of the laser beam is placed opposite to a surface other than the emission surface of the cathode;

wherein the side disposed opposite to the emission surface of the cathode is located in the laser beam path;

and further comprising a member selected from the group consisting of a photodetector, a solid-state image sensor, an optical fiber waveguide connected to a photo detector, an optical fiber waveguide connected to a solid-state image sensor and combinations thereof and placed opposite to a surface of the anode and in the path of the light of the laser beam, and a member selected from the group consisting of a control unit, a closed-loop control system and combinations thereof, wherein the source of the laser beam and the member selected from the group consisting of a photodetector, a solid-state image sensor, an optical fiber waveguide connected to a photo detector, an optical fiber waveguide connected to a solid-state image sensor and combinations thereof and the member selected from the group consisting of a control unit, a closed-loop control system and combinations thereof are interconnected.

3. The electron gun according to claim 1, wherein the source of the laser beam is an optical facility to decouple a laser beam which optically connected to a laser beam generating facility through at least one optical fiber or fiber laser; and wherein the laser beam generating facility for generating a laser beam is disposed outside of the housing in the first end said optical fiber or fiber laser;

wherein the optical facility to decouple a laser beam is dispose inside of the second end said optical fiber or fiber laser.

4. The electron gun according to claim 3 further comprising an electroconductive waveguide;

an optical fiber located in the said waveguide;

a cathode anchor and wherein a hole of the cathode anchor forms a direct electroconductive connection to the said waveguide.

5. An electron gun comprising a housing;

a cathode having an emission surface on a first side and an irradiation surface on a second side of the cathode disposed opposite to the first side and said cathode being mounted in the housing;

a gate electrode disposed adjacent to the cathode for controlling the beam of electrons emitted by the cathode and mounted in the housing;

an anode mounted in the housing and disposed at an appropriate distance from the cathode for building tip a voltage between cathode and anode and for accelerating electrons emitted by the cathode;

a source of a laser beam for directing a laser beam to the irradiation surface of the cathode;

wherein the source of the laser beam is an optical facility to decouple a laser beam together with and optically connected to a laser beam generating facility through at least one optical fiber; and wherein the laser beam generating facility for generating a laser beam is dispersed outside of the housing;

a waveguide;

an optical fiber located in the waveguide;

a cathode anchor and wherein a hole of the cathode anchor forms a direct electroconductive connection to the waveguide;

a power supply unit;

a high voltage plug connected to the power supply unit, wherein said waveguide is a component of a high-voltage plug;

wherein a second end of said waveguide is placed outside the housing wherein and a first end of said waveguide is disposed at a distance from about 2 to 150 millimeters relative to the cathode or inside the cathode anchor; and a power supply unit, wherein said waveguide has an electroconductive connection to supply unit for the cathode.

6. The electron gun according to claim 3, wherein the facility generating the laser beam is a solid-state laser.

7. An electron gun comprising a housing;

a cathode having an emission surface on a first side and an irradiation surface on a second side of the cathode disposed opposite to the first side and said cathode being mounted in the housing;

a gate electrode disposed adjacent to the cathode for controlling the beam of electrons emitted by the cathode and mounted in the housing;

an anode mounted in the housing and disposed at an appropriate distance from the cathode for building up a voltage between cathode and anode and for accelerating electrons emitted by the cathode;

a source of a laser beam for directing a laser beam to the irradiation surface of the cathode;

wherein the source of the laser beam is an optical facility to decouple a laser beam together with and optically connected to a laser beam generating facility through at least one optical fiber; and wherein the laser beam generating facility for generating a laser beam is disposed outside of the housing;

a member selected from the group consisting of a spherical lens, a half sphere, a taper, a two-sided beveling of the optical fiber, and combinations thereof, wherein the facility generating the laser beam is optically connected to the optical fiber (10) through the member selected from the group consisting of a spherical lens, a half sphere, a taper, a two-sided beveling of the optical fiber, and combinations thereof.

8. The electron gun according to claim 1 further comprising a fiber laser, wherein the optical facility to decouple laser beams is connected through the fiber laser to a light beam generating facility that functions as a pumping source;

wherein the cathode is located in the laser beam path.

9. The electron gun according to claim 3, wherein the optical facility to decouple laser beams is a member selected from the group consisting at least one optical fiber, a half sphere placed at the end of said optical fiber, a lens placed in the downstream beam path from the end of said optical fiber, and combinations thereof.

10. The electron gun according to claim 9, wherein the half sphere is melted on the end of optical fiber (10), or/and comprises a cast resin.

11. An electron gun comprising a housing;

a cathode having an emission surface on a first side and an irradiation surface on a second side of the cathode disposed opposite to the first side and said cathode being mounted in the housing;

a gate electrode disposed adjacent to the cathode for controlling the beam of electrons emitted by the cathode and mounted in the housing;

an anode mounted in the housing and disposed at an appropriate distance from the cathode for building up a voltage between cathode and anode and for accelerating electrons emitted by the cathode;

a source of a laser beam for directing a laser beam to the irradiation surface of the cathode;

wherein the optical facility to decouple laser beams is a member selected from the group consisting of the end of at least one optical fiber, a half sphere placed at the end of said optical fiber, a lens placed in the downstream beam path from the end of said optical fiber, and combinations thereof;

wherein the optical facility is a half sphere melted on and comprises a cast resin.

12. The electron gun according to claim 1, wherein the cathode is a member selected from the group consisting of a band cathode, a band cathode with an electrode emitting body attached to it, a pin cathode, and combinations thereof.

13. The electron gun according to claim 12, wherein said pin cathode comprises two circular or cylindrical bodies with differing diameters that are placed parallel to one another, and wherein the electron-emitting surface is small circular or cylindrical body having a diameter of from about 5 to 14 millimeters, and wherein an indentation and/or a projection on the greater cylindrical surface is used for fixing of said pin cathode in position.

14. The electron gun according to claim 12, wherein the electron-emitting component of the pin cathode exhibits a bolt shape such that the electron-emitting surface is a large circular or cylindrical head.

15. The electron gun according to claim 2 further comprising measuring equipment used to determine laser power and the resulting cathode temperature, wherein a member selected from the group consisting of photodetector, solid-state image sensor, a control unit, a closed-loop control system, and combinations thereof is part of the measuring equipment.

16. An electron gun with an indirectly heated cathode, gate electrode and anode mounted in one housing and used for processing workpieces, characterized in that at least one solid-state laser and/or at least one optical facility to decouple laser beams is placed opposite at least one surface other than the emission surface of the cathode and within the electron gun (1) in such a way that the cathode is located in the laser beam path.

17. An electron gun with an indirectly heated cathode, gate electrode and anode mounted in one housing and used for processing workpieces, in particular the electron gun according to claim 16, characterized in that at least one solid-state laser and/or at least one optical facility to decouple laser beams is placed opposite at least one surface other than the emission surface of the cathode and within the electron gun (1) in such a way that the cathode is located in the laser beam path;

a photodetector, a solid-state image sensor, or an optical fiber waveguide (37) connected to a photo detector or solid-state image sensor is placed opposite an additional surface; and at least the laser diode or the facility generating laser beams and/or the photodetector or the solid-state image sensor is interconnected with a control unit or a closed-loop control system (29).

18. The electron gun according to claim 17, characterized in that the optical facility to decouple laser beams is optically connected with a laser beam generating facility via at least one optical fiber (10); and in that the facility generating laser beams is placed outside the electron gun (1);

the optical fiber (10) is located in a waveguide (11); and that said waveguide (11) has a direct electroconductive connection to the cathode via at least one part of the cathode anchor;

said waveguide (11) is a component of a high-voltage plug (12);

a first end of said waveguide (11) is placed outside the housing (5) of the electron gun (1) and its second end is close to the cathode or inside the cathode anchor; and that said waveguide (11) has an electroconductive connection to a power supply unit for the cathode (30);

the facility generating the laser beams is a solid-state laser;

the facility generating the laser beams is connected to the optical fiber (10) directly, via a spherical lens (19), a half sphere (21), a taper, or a two-sided beveling of the optical fiber (10);

the optical facility to decouple laser beams is connected via a fiber laser to a light beam generating facility that functions as a pumping source;

the optical facility to decouple laser beams is comprised of the end of at least one optical fiber (10), a half sphere placed at the end of said optical fiber (10), or at least one lens placed in the downstream beam path from the end of said optical fiber;

the half sphere is melted on or consists of a cast resin.

19. The electron gun according to claim 17, characterized in that the facility to decouple laser beams is comprised of two lenses (25*a*, 25*b*) placed at a distance to one another; the cathode is a band cathode (2), a band cathode (2) with an electrode emitting body (8) attached to it, or a pin cathode (26).

20. The electron gun according to claim 19, characterized in that at least one surface of said pin cathode (26) is comprised of at least one indentation and/or at least one projection, and that the electron-emitting surface is circular;

the electron-emitting component of the pin cathode (26) is a bolt;

the photodetector or solid-state image sensor and/or the control unit or closed-loop control system (29) are paid of the measuring equipment that is used to determine laser power and the resulting cathode temperature.

* * * * *